US006532635B1

(12) United States Patent
Gregory

(10) Patent No.: US 6,532,635 B1
(45) Date of Patent: Mar. 18, 2003

(54) INSTALLATION TOOL FOR PULL TYPE FASTENERS

(75) Inventor: Jack T. Gregory, Sonoma, CA (US)

(73) Assignee: Huck International, Inc., Tucson, AZ (US)

( * ) Notice: Subject to any disclaimer, the term of this patent is extended or adjusted under 35 U.S.C. 154(b) by 0 days.

(21) Appl. No.: 10/087,695

(22) Filed: Mar. 1, 2002

(51) Int. Cl.[7] ..... B21J 15/20; B21D 31/00

(52) U.S. Cl. ..... 29/243.523; 29/243.525; 72/391.4

(58) Field of Search ..... 72/391.4, 391.6, 72/391.8; 29/243.523, 243.524, 243.525

(56) References Cited

U.S. PATENT DOCUMENTS

| | | | | | |
|---|---|---|---|---|---|
| 4,031,619 | A | | 6/1977 | Gregory | |
| 4,248,077 | A | | 2/1981 | Gregory | |
| 4,263,801 | A | | 4/1981 | Gregory | |
| 4,329,121 | A | | 5/1982 | Gregory | |
| 4,342,216 | A | | 8/1982 | Gregory | |
| 4,347,728 | A | | 9/1982 | Smith | |
| 4,489,471 | A | | 12/1984 | Gregory | |
| 4,498,293 | A | | 2/1985 | Gregory | |
| 4,515,005 | A | * | 5/1985 | Klein | 29/243.525 |
| 4,520,648 | A | | 6/1985 | Gregory | |
| 4,580,435 | A | | 4/1986 | Port | |
| 4,653,308 | A | | 3/1987 | Gregory | |
| 4,735,048 | A | | 4/1988 | Gregory | |
| 4,863,325 | A | | 9/1989 | Smith | |
| 5,072,501 | A | * | 12/1991 | Vincenzo | 29/243.525 |
| 5,090,852 | A | | 2/1992 | Dixon | |
| 5,425,164 | A | * | 6/1995 | El Dessouky | 29/243.524 |
| 5,485,727 | A | * | 1/1996 | Godfrey | 29/243.523 |
| 6,077,009 | A | | 6/2000 | Hazelman | |
| 6,272,899 | B1 | | 8/2001 | Bentivogli | |
| 6,367,139 | B2 | * | 4/2002 | Wille | 29/243.525 |

* cited by examiner

*Primary Examiner*—David Jones
(74) *Attorney, Agent, or Firm*—Harness, Dickey & Pierce, P.L.C.

(57) ABSTRACT

A manually applied installation tool, for setting fasteners by applying a relative axial pulling force thereto and including a first hydraulic piston in a first hydraulic cylinder for reciprocation in response to a preselected high hydraulic pressure for applying the relative axial pulling force, a second hydraulic piston in a second hydraulic cylinder for reciprocation between compressive and non-compressive directions for providing hydraulic fluid at the high hydraulic pressure to the first hydraulic cylinder for application of the axial pulling force by the first hydraulic piston, a fluid reservoir having a supply of hydraulic fluid for compression by the second hydraulic piston and flow to the first hydraulic cylinder through an access valve, a high pressure relief valve connected to the second hydraulic cylinder and actuable to relieve the fluid pressure at a preselected high magnitude with flow of hydraulic fluid back to the fluid reservoir. The installation tool including a refill valve operable for permitting flow of hydraulic fluid from the fluid reservoir into the second hydraulic cylinder upon reciprocating movement of the second hydraulic piston in a non-compressive direction and with the pressure relief valve, refill valve and access valve being substantially axially in line with the second hydraulic piston along its axis of reciprocation.

21 Claims, 18 Drawing Sheets

INSTALLATION TOOL FOR PULL TYPE FASTENERS

FIELD OF THE INVENTION

The present invention relates to tools for installing pull type fasteners and more particularly to such tools which are pneumatically-hydraulically or manually-hydraulically actuated.

BACKGROUND OF THE INVENTION

The installation tools of the present invention are designed for use in setting multi-piece fasteners. The specific embodiments shown and described herein were designed for the installation of multi-piece pull type fasteners including two piece blind fasteners such as that described in the U.S. Pat. No. 4,863,325 issued Sep. 5, 1989 to W. Smith for "Two Piece Blind Fastener with Lock Spindle" and blind fasteners with more than two pieces such as that shown in U.S. Pat. No. 6,077,009 issued Jun. 20, 2000 to D. Hazelman for "Blind Fastener With High Strength Blind Head . . . ". The tools can also be adapted to install swage type fasteners such as that shown in U.S. Pat. No. 5,090,852 issued Feb. 25, 1992 to R. Dixon for "High Strength Fastener And Method".

Two piece fasteners of the type noted are set by hydraulic pressure which is used to create a relative axial pulling force applied by a nose assembly section between a pin and a sleeve or collar. With such fasteners installation is completed when a pintail portion of the pin is finally severed at a breakneck groove by the pulling force from the tool. Such fasteners can be installed by pneumatically-hyraulically actuated tools. In this case the hydraulic pressure is created by pneumatic pressure actuation. An example of such a tool is shown in U.S. Pat. No. 4,580,435, issued Apr. 8, 1986 to Port et al. Such tools can also be manually-hydraulically actuated. Examples of such tools are shown in U.S. Pat. No. 4,248,077, issued Feb. 3, 1981 to Gregory, U.S. Pat. No. 4,263,801, issued Apr. 28, 1981 to Gregory, U.S. Pat. No. 4,489,471 issued Dec. 25, 1984 to Gregory and U.S. Pat. No. 4,735,048 issued Apr. 5, 1988 to Gregory. There the hydraulic pressure is created by manual actuation. Such fasteners can be installed by pneumatically-hydraulically actuated tools. In this case the hydraulic pressure is created by pneumatic pressure actuation. An example of such a tool is shown in U.S. Pat. No. 4,580,435, issued Apr. 8, 1986 to Port et al. In addition pull type fasteners without a frangible pintail can be installed with the tools of the present invention.

SUMMARY OF THE INVENTION

In the installation of such pull type fasteners, it is desirable to have an installation tool which is compact and of a lightweight construction.

In the present invention, a construction is utilized which facilitates manufacture of both pneumatic-hydraulic and manual-hydraulic versions with both being of a compact lightweight construction. In this regard, a unique hydraulic pump section for providing the hydraulic pressure to the nose assembly section is provided and includes a series of valves which are in axial alignment and has a piston structure providing a coaxial fluid passage. As will be seen this hydraulic pump section with axially aligned valves having coaxial fluid passages facilitates manufacture and assembly of both the pneumatic and manually actuated tools while providing compact, lightweight structures. In this regard the hydraulic pump and the valves are substantially axially aligned together.

The pneumatic-hydraulic tool of the present invention utilizes a typically, relatively low, pneumatic pressure to provide the reciprocating action of the pneumatic drive mechanism for developing the necessary hydraulic working pressure to the nose assembly section for the pull force for installing the fastener. In this regard a unique exhaust actuating structure is utilized to cause the motoring of the pneumatic drive mechanism to provide the desired reciprocation of the hydraulic pump mechanism. At the same time, the pneumatic drive mechanism can be axially aligned with the hydraulic pump and associated valves.

In addition the housing for the pneumatic-hydraulic tool is of a two piece structure with substantially identical mirror image halves which facilitates the manufacture, assembly and maintenance of the tool.

Therefore, it is an object of the present invention to provide a new and unique construction for use with pneumatic-hydraulic and manual-hydraulic fastener installation tools resulting in compact and lightweight constructions.

It is another object of the present invention to provide a new and improved hydraulic pump section including axially in-line valves with coaxial fluid passages adaptable for use with pneumatic-hydraulic and manual-hydraulic tools for providing constructions which facilitate manufacture and provide tools of compact, lightweight structures.

It is still another object of the present invention to provide a tool with a new and improved hydraulic pump section including axially in-line valves which are substantially in axial alignment with the hydraulic pump mechanism.

It is another object of the present invention to provide a pneumatic-hydraulic tool having a new improved hydraulic pump section including axially in-line valves with coaxial fluid passages which is substantially in axial alignment with the hydraulic pump mechanism and also substantially in axial alignment with the pneumatic drive piston for actuating the hydraulic pump section.

It is another object of the present invention to provide a hydraulic-pneumatic tool having a housing of a two piece structure with substantially identical mirror image halves.

It is a general object of the present invention to provide a new and improved pneumatic-hydraulic fastener installation tool.

It is a general object of the present invention to provide a new and improved manual-hydraulic fastener installation tool.

Other objects, features, and advantages of the present invention will become apparent from the subsequent description and the appended claims, taken in conjunction with the accompanying drawings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application or uses.

Figure 1:
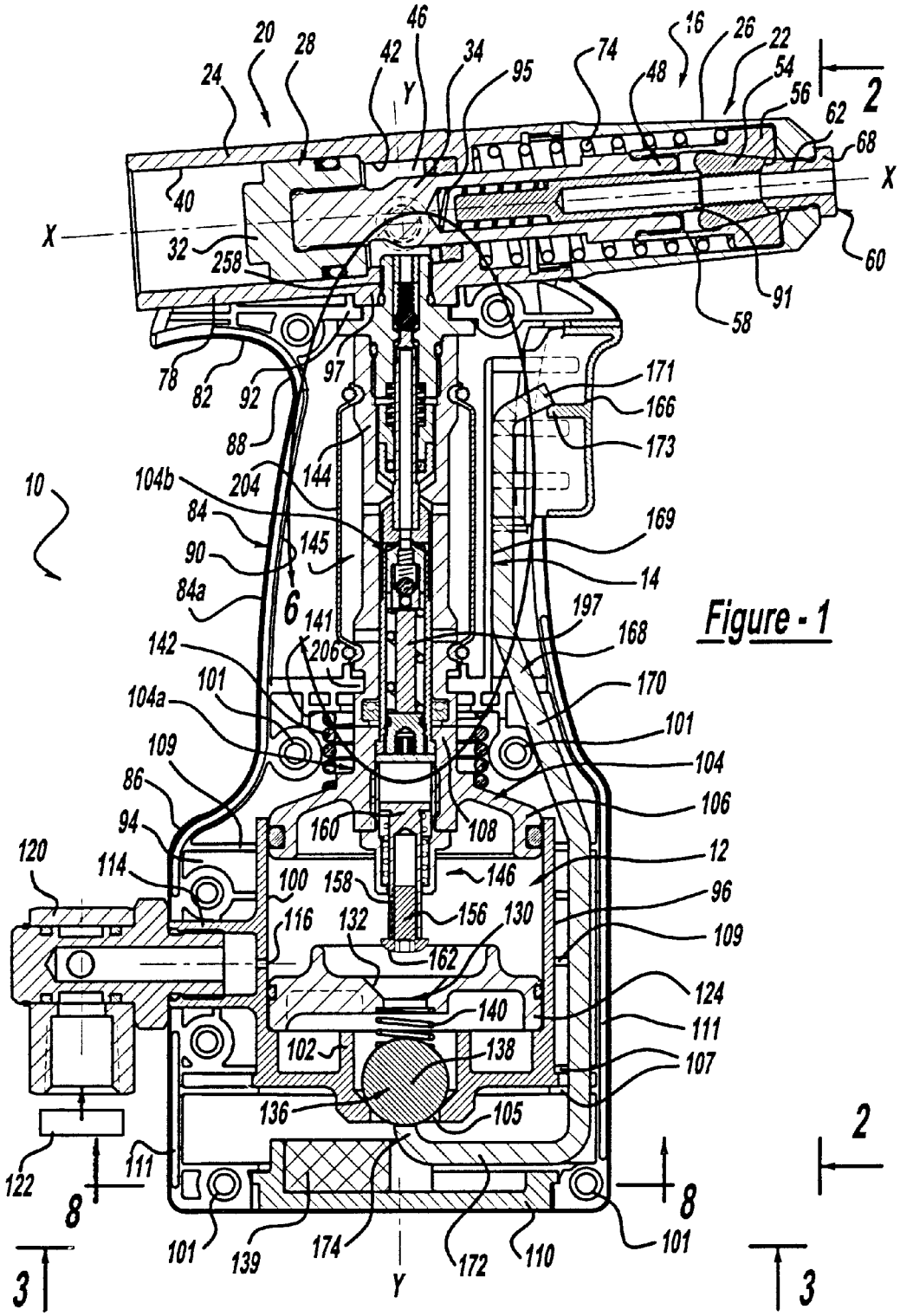
FIG. 1 is a side elevational, sectional view of a pneumatic-hydraulic installation tool embodying features of the present invention and including a hydraulic pump section including in-line valves and shown in a condition with the tool in an idle, non-actuated but pneumatically pressurized state.

Looking now to FIG. 1 a pneumatic-hydraulic fastener installation tool 10 is shown and includes a pneumatic, air pump section 12, a hydraulic pump section 14 and a hydraulically actuated nose assembly section 16. In operation the hydraulic pump section 14 is operatively connected with the air pump section 12 such that actuation of the air pump section 12, at a relatively low pneumatic pressure, will in turn cause actuation of the hydraulic pump section 14 to provide a relatively high hydraulic pressure to the nose assembly section 16. Typical magnitudes of pressure are 90 psi pneumatic pressure to develop a hydraulic working pressure of 11,000 psi.

The nose assembly section 16 can be of a conventional construction or other pull type form for providing a relative axial pulling force to install pull type fasteners, as noted, in response to the hydraulic pressure from the hydraulic pump section 14. The nose assembly section 16 includes a pull piston assembly 20 and an anvil assembly 22. The piston assembly 20 has a hydraulic cylinder housing 24 which has a cylinder cavity of a stepped construction including an enlarged diameter section 40 and a reduced diameter section 42.

In this regard the piston assembly 20 includes a pull piston 28 mounted in the cylinder cavity for reciprocating motion along a longitudinal X axis. The X axis is slightly inclined relative to a transverse Y axis of the pneumatic-hydraulic tool 10. Pull piston 28 has an enlarged hydraulic piston head 32 and a forwardly extending reduced diameter piston rod 34.

The piston rod 34 is connected to the piston head 32 by the threaded engagement of the inner end portion of the piston rod 34 with a threaded bore in the piston head 32. The piston head 32 is slidably supported in the enlarged diameter section 40 of the cylinder cavity.

The piston rod 34 extends through the reduced diameter section 42 of the cylinder cavity. As will be seen, the reduced diameter section 42 of the cylinder cavity is adapted to initially receive hydraulic fluid under a relatively high pressure to effectuate a pull stroke of the piston 28.

The piston rod 34 also extends axially through a front radial wall at the front end of reduced diameter section 42 and substantially beyond the reduced diameter section 42 into an outer anvil housing 26. In this regard, the reduced diameter section 42 with the front radial wall and a portion of the enlarged diameter section 40 define a hydraulic pressure cylinder cavity 46. The operative volume of cylinder cavity 46 will vary depending upon the position of the piston head 32 in the enlarged diameter section 40 from idle to fully actuated during the pull stroke of the piston 28.

The outer anvil housing 26 is threadably secured to a threaded bore at the outer end of the cylinder housing 24 thereby securing the anvil assembly 22 to the pull piston assembly 20. The anvil assembly 22 includes an inner collet assembly 48. The collet assembly 48 in turn is threadably secured to the outer end of the piston rod 34. Thus as pull piston 28 reciprocates along the X axis it will similarly reciprocate the collet assembly 48 within the outer anvil housing 26. The collet assembly 48 includes a plurality of gripping jaws 54 supported in an enlarged diameter boss 56 at the outer end of a collet housing 58. The jaws 54 are adapted to grip the pin of the fastener to be set. The anvil assembly 22 also includes an anvil member 60 having an inner portion 62 threadably secured to a bore at the outer end of the anvil housing 26 with an enlarged flange 68 engaged with the outer end of the anvil housing 26. The flange 68 is also adapted to engage the head of a fastener sleeve or the end of a collar. In the case of the sleeve head, the flange 68 is adapted to engage a protruding or flush type head and thus is of a limited axial width.

The collet assembly 48 is normally biased to its forward-most position when deactuated by a return coil spring 74 which is engaged between the enlarged diameter boss 56 of the collet housing 58 and the front wall of the cylinder housing 24. The jaws 54 have a generally frusto-conically shaped outer surface adapted to be matingly slidably supported in a frusto-conically shaped bore through the boss 56. The jaws 54 can be of a construction generally as shown in U.S. Pat. No. 4,520,648 to Gregory supra. In this regard three circumferentially equally spaced jaws 54 can be used as shown in U.S. Pat. No. 4,347,728 issued Sep. 7, 1982 to Smith. Thus the jaws 54 are formed with a plurality of gripping teeth, of a conventional structure as noted, on their arcuate inner surfaces defining a generally axially straight central jaw opening. The jaws 54 are provided with radially inwardly tapered surfaces at their outer ends adapted to engage a mating, radially outwardly tapered section at the inner end of the inner portion 62 of the anvil member 60. At the same time the jaws 54 have similar radially inwardly tapered surfaces at their ends adapted to engage the outer end of a reduced diameter jaw biasing rod 91. The bias rod 91 is slidably supported within a central bore extending inwardly from the outer end of the piston rod 34. A coil spring 95 in the central bore engages the bias rod 91 biasing it axially outwardly with the bias rod 91 resiliently engaged with the tapered surfaces of jaws 54. Thus with the nose assembly section 16 deactuated to the position shown in FIG. 1, the resilient engagement of the bias rod 91 with the tapered surfaces of jaws 54 will urge the inwardly tapered surfaces at the inner ends of jaws 54 into engagement with the tapered section at the inner portion 62 of anvil member 60 and will thereby bias the jaws 54 radially outwardly to their open position. In this open position the end of the fastener pin with pull grooves can be readily moved through the opening defined by the jaws 54. In addition, the bias rod 91 has a central bore in line with the jaw opening in order to receive the extra length of the pintail that may extend through the jaw opening.

Now when the nose assembly section 16 is energized by hydraulic fluid pressure in cylinder cavity 46 the pull piston 28 will be moved axially rearwardly moving the collet assembly 48 rearwardly. As this occurs the jaws 54 will be moved radially inwardly from the mating engagement of the radially outer frusto-conical surfaces and against the bias of the bias rod 91 with the jaw teeth engaging the pull grooves of the fastener pin to exert a relative axial force between the fastener pin and the collar or sleeve by engagement therewith of the flange 68 of the anvil member 60. In the drawings, the pin and engagement with the jaws 54, which are well known in the art, have been omitted for purposes of simplicity and brevity. In this regard, it should be noted that the jaw teeth could be constructed to be relatively sharp to bite into a pintail portion having a relatively smooth surface without pull grooves.

The action applied between the collet assembly 48 and anvil member 60 results in a relative axial force applied to the fastener to set the fastener and whereby after it is set the pull portion of the pin is severed. As noted fasteners without a frangible pintail, pull portion can also be installed.

When this occurs the installation tool 10 is deactuated whereby the nose assembly section 16 will be returned to the condition shown in FIG. 1. Now the jaws 54 will be biased by the return spring 74 to their opened position releasing the severed pintail or a non-severable pintail such that it can be freely ejected from the nose assembly section 16.

In this condition the radially outer, forward end of the hydraulic piston head 32 will engage a radially inwardly extending stop surface at the inner or rearward end of the cylinder cavity 46 when the pull piston 28 is in its forwardmost or return position as biased by the return spring 74 and as shown in FIG. 1.

As noted, in order to drive different fasteners with a relative axial force, a nose assembly section different from nose assembly section 16 may be required and can be readily used with the tool 10.

The cylinder housing 24 of nose assembly section 16 has a base section 78 which is adapted to be seated upon a transversely extending upper platform portion 82 of an elongated main housing 84 whereby the nose assembly section 16 can be connected to the main housing 84 in a manner to be described. The main housing 84 has a relatively large diameter or cross-sectioned pneumatic cylinder portion 86 and relatively narrow cross sectioned neck or handle portion 88 which terminates at its upper end in the enlarged platform portion 82.

Figure 2:
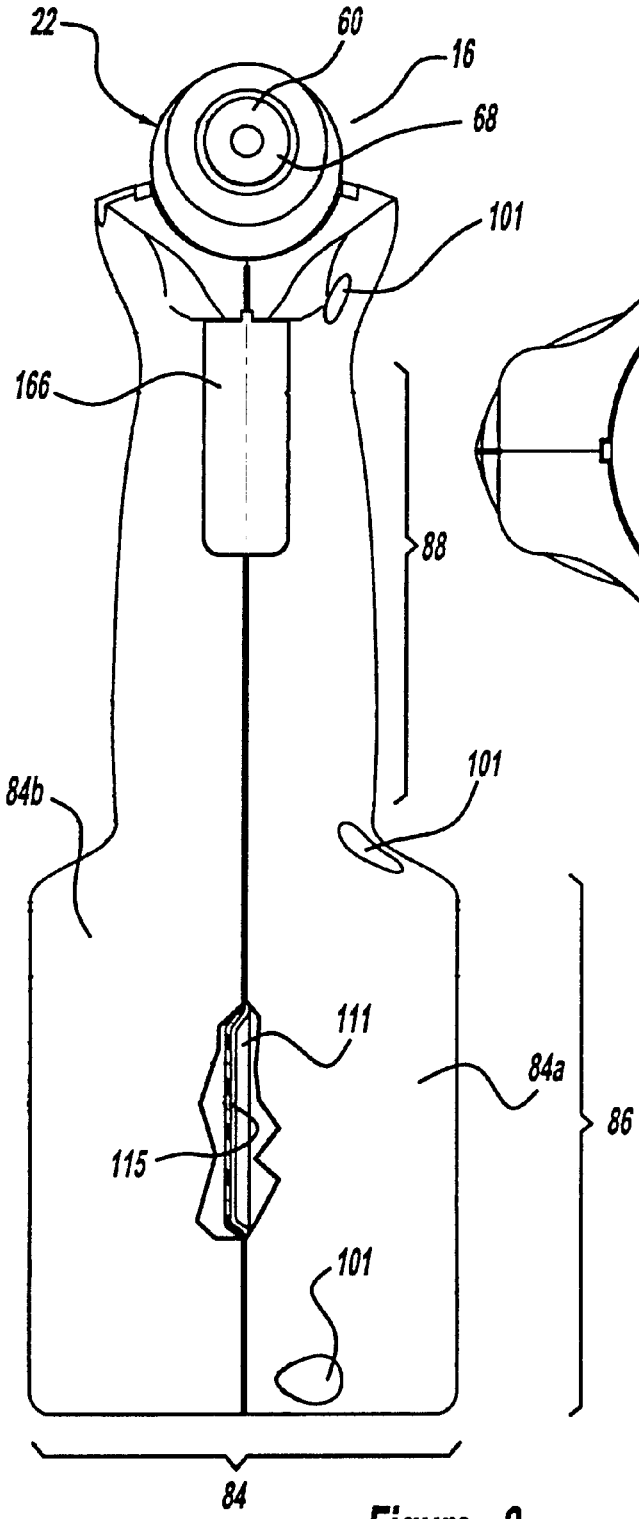
FIG. 2 is a front elevational view of the installation tool of FIG. 1 taken in the direction of the Arrows 2—2 in FIG. 1 and with a portion of the two piece housing broken away to depict an interconnection.

The neck 88 is tubular and has a generally oblong section with the major diameter or length as shown in FIG. 1 and with the minor diameter or width as shown in FIG. 2. A central, through bore 90 terminates at its upper end with an annular reduced diameter flange 92 and at its lower end in an enlarged cavity 94 in the large diameter pneumatic cylinder portion 86. The base section 78 of cylinder housing 24 of the nose assembly section 16 has a downwardly extending, axially offset annular ring portion 97 adapted to be matingly received within the annular flange 92 of the main housing 84.

Figure 1A:
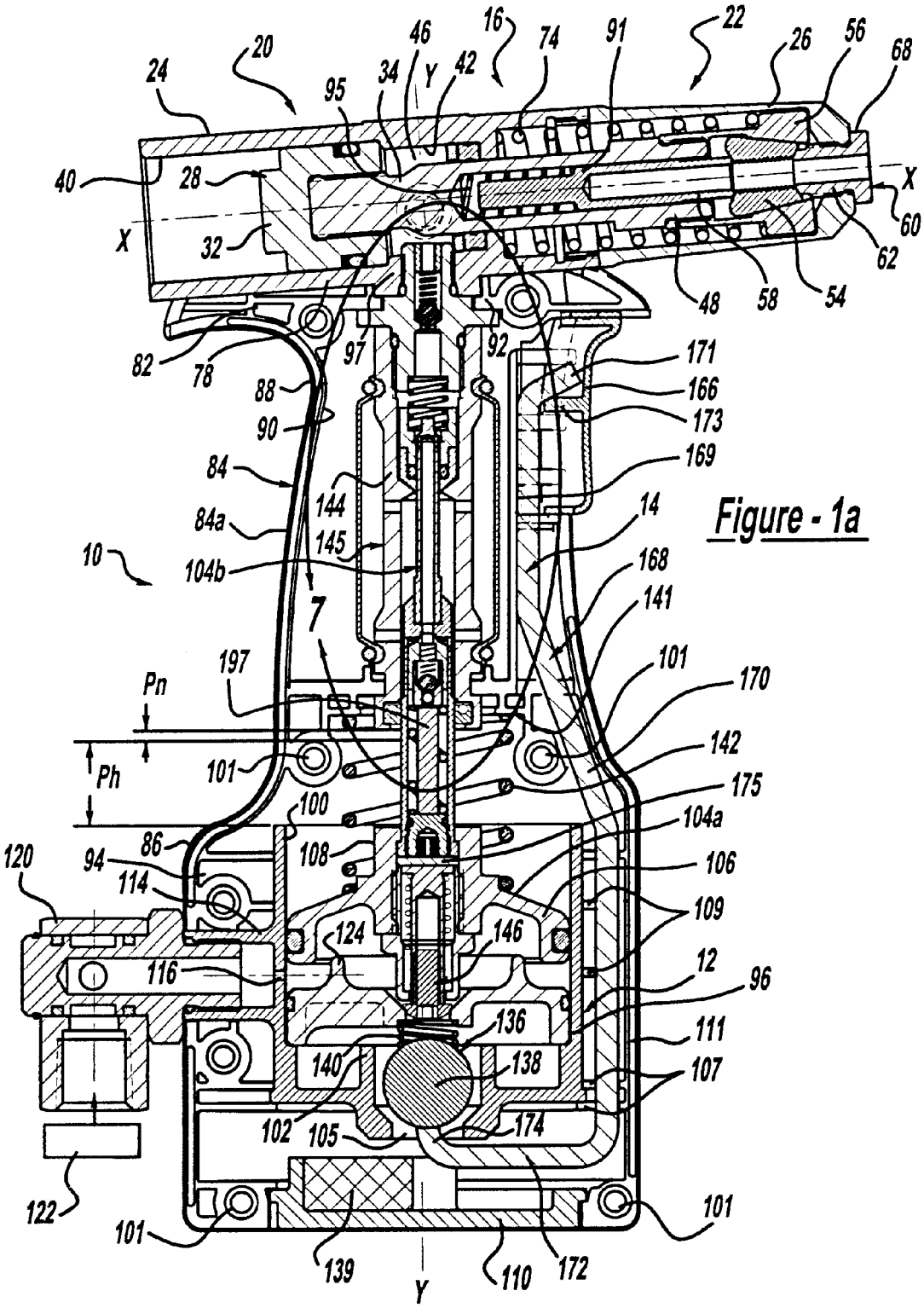
FIG. 1*a* is a view similar to FIG. 1 depicting the installation tool at one stage in its actuated state with pneumatic pressure applied; however, for purposes of simplicity a fastener to be installed is not shown.
Figure 8:
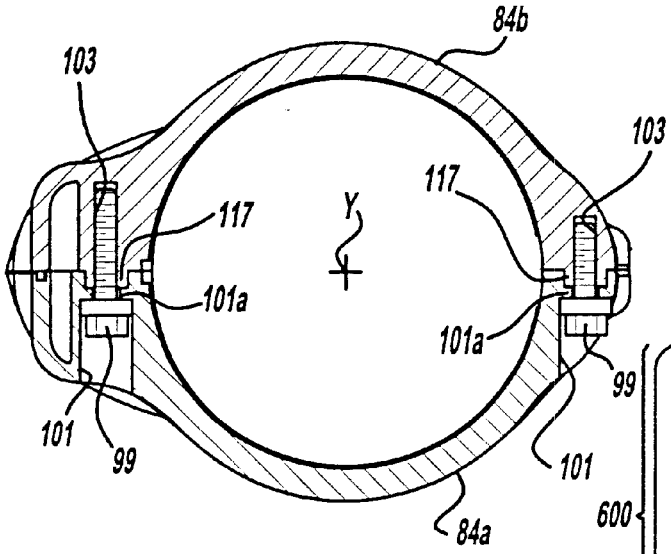
FIG. 8 is a sectional view of the two piece housing structure of the installation tool of FIGS. 1–7 taken generally in the direction of the Arrows 8—8 in FIGS. 1 and 2 and primarily depicting the interconnection between the housing halves.

The main housing 84 is of a two piece structure comprised of housing halves 84*a* and 84*b* which are of generally identical mirror image constructions (See FIGS. 2 and 8). The housing half 84*a* is shown in FIGS. 1 and 1A. The housing halves 84*a* and 84*b* are connected together by self-tapping bolts 99 having a head portion and a threaded shank portion extending into a plurality of bores 101 and 103, respectively. See FIG. 8. The bores 101 in housing half 84*a* are through bores which extend transversely to the Y axis of the main housing 84 and have an outer enlarged counterbore portion at its outer end connected to an inner enlarged bore portion at its inner end with a reduced diameter portion 101*a* being intermediate of the outer and inner enlarged bore portions. At the same time the bores 103 in housing half 84*b* also extend transversely to the Y axis and are in alignment with the bores 101. The bores 103, however, are closed at their outer ends, and have cylindrical bosses 117 extending inwardly from their inner ends. The bosses 117 are adapted to matingly fit within the inner enlarged bore portions in housing half 84*a* to facilitate alignment of the bores 101 and 103 and of the housing halves 84*a* and 84*b* and also to strengthen the connection of the housing halves 84*a* and 84*b*. As can be seen in FIG. 8, the bores 101 while generally of the same construction may differ somewhat depending upon the location in the housing half 84*a*. The same is true of bores 103 in housing half 84*b*.

At the same time the housing half 84*a* has reduced thickness ribs 111 extending outwardly generally around the periphery of its end surface. The housing half 84*b*, in turn, has mating grooves 115 located in its end surface and extending generally co-extensively with the ribs 111 of housing half 84*a*. See FIG. 2. In assembling the housing halves 84*a* and 84*b*, the peripheral ribs 111 are matingly located in the peripheral grooves 115 with the bosses 117 in housing half 84*a* located in the outer enlarged bore portions of bores 101 Now, the housing halves 84*a* and 84*b* are removably locked together by the self-tapping bolts 99. The enlarged heads of the bolts 99 are located in the outer counterbore portions at the outer end of the through bores 101 with the threaded shank portions extending through the reduced diameter portions 101*a* with clearance. The threaded shank portions of the bolts 99 then move into engagement with the bores 103 in housing half 84*b*. The bores 103 are of a reduced diameter less than that of the shank portions of the bolts 99. The threaded shank portions of the self-tapping bolts 99 are then threaded into the bores 103. The self-tapping is facilitated by the fact that the main housing 84, as will be noted, is made of a plastic material. This then securely joins the housing halves 84*a* and 84*b* together. The bolts 99, of course, can be readily removed for separation of the housing halves 84*a* and 84*b* for maintenance, repair, etc. of the tool 10. When assembled an end cap 110 is clamped in place at the lower, open end of the large diameter cylinder portion 86 of the main housing 84.

A one piece pneumatic cylinder structure 96 is fixedly supported within the cavity 94 at the large diameter cylinder portion 86 of the main housing 84. The cylinder structure 96 has a pneumatic cylinder cavity 100 which is open at its upper end and has an annular pocket 102 at its opposite or lower end which has a reduced diameter exhaust port or bore 105 which serves a purpose to be described. The annular pocket 102 can communicate the pneumatic cylinder cavity 100 to the atmosphere through the reduced diameter exhaust bore 105 in a manner to be described. The cylinder structure 96 is axially supported on radially inwardly, circumferentially extending ledges such as ledges 107 and is also held in a radially and axially fixed position by other elements including additional generally circumferentially, radially extending ribs such as ribs 109.

A pneumatic-hydraulic piston assembly 104 includes a pneumatic piston structure 104*a* operatively connected to a hydraulic piston structure 104*b*. The details of the pneumatic-hydraulic piston assembly 104 and the pneumatic piston structure 104*a* and hydraulic piston structure 104*b* may be most clearly seen in FIGS. 4 and 5. Thus many of the numeral references are shown only in FIGS. 4 and 5.

The pneumatic piston structure 104*a* has an enlarged pneumatic piston head 106 at its lower end which is reciprocably supported within the cylinder cavity 100. The pneumatic piston head 106 has a reduced diameter end portion 108 extending upwardly therefrom. An annular seal in piston head 106 provides a pneumatic seal between the piston head 106 and the confronting wall surface of the cavity 100. In this regard it can be seen from the drawings that numerous seals are shown. However, since such seals are of constructions well known in the art the specific designation and description of same have been essentially omitted for purposes of brevity and simplicity.

The cylinder structure 96 has an integral annular, tubular inlet connector section 114 extending transversely from the cavity 100 with the tubular section 114 in fluid communication with the cavity 100 via a reduced diameter air inlet bore 116. The tubular section 114 has an internally threaded portion for threadable connection with a pneumatic coupling 120 having a pivotal structure which in turn is adapted to be pivotally connected to a conventional pneumatic line (not shown) from a supply of pneumatic pressure generally indicated by the numeral 122. The coupling 120 and air pressure supply 122 are of conventional structures and hence the details thereof, which do not constitute a part of the present invention, have been omitted for purposes of simplicity and brevity.

Figure 3:
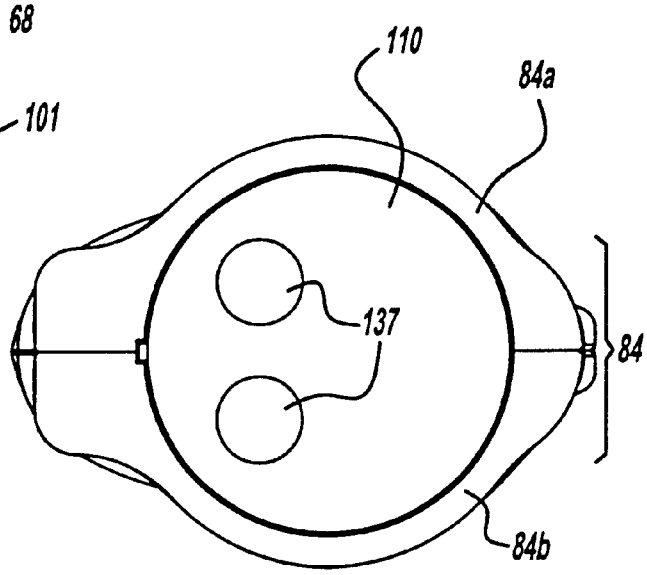
FIG. 3 is a bottom elevational view of the installation tool of FIG. 1 taken in the direction of the Arrows 3—3 in FIG. 1.

A generally annular separator plate 124 is substantially fixedly located within the pneumatic cylinder cavity 100 at its lower end. The plate 124 is supported upon an annular shoulder in the cavity 100 at a proximate but spaced relationship relative to the annular pocket 102 and thereby separates an upper portion of the cavity 100 from the pocket 102 for a purpose to be described. The separator plate 124 has a central exhaust through bore 130 which has a straight exhaust bore portion connected at its upper end with a radially outwardly tapered sealing bore portion 132. The central through bore 130 is generally co-axial with the reduced diameter exhaust bore 105 of the annular pocket 102. The separator plate 124 has an annular seal in its radially outer surface which provides a seal with the confronting surface of the cavity 100. A ball check exhaust valve assembly 136 is actuable to provide a pneumatic exhaust to the atmosphere at the bore 105 and includes a ball seal 138 which is engageable with an upper tapered portion connected to the reduced diameter exhaust bore 105. The ball seal 138 is biased into sealing engagement with the tapered seat portion by pneumatic pressure in the cavity 100 and also by bias from a coil spring 140 which serves an additional purpose to be described. In this regard the end cap 110 has a pair of exhaust bores 137 which open to the atmosphere whereby the air can flow outwardly from the cylinder cavity 100 when the ball seal 138 is unseated. See FIG. 3. In addition a porous filter 139 is located in the end cap 110 over the exhaust bores 137 to control the outward exhaust of air to avoid a directed pressure force and also to muffle the sound of the exhaust. See FIGS. 1 and 1*a*.

As shown in FIG. 1, the pneumatic-hydraulic installation tool 10 is in the idle, non-actuated state, however, with pneumatic pressure applied. A coil spring 142 is in engagement with the vertically upper side of the piston head 106 and a fixed surface 141 in the through bore 90 of the neck 88 of the main housing 84 to resiliently bias the pneumatic piston structure 104*a*, and thus the pneumatic-hydraulic piston assembly 104, vertically downwardly. However, as can be seen, the pneumatic pressure source 122 continuously applies pressure to the cavity 100 via the coupling 120 and the inlet bore 116. The magnitude of pressure and the area of the piston head 106 are such that in the idle condition with the exhaust bore 105 closed the pneumatic piston structure 104*a*, and thus the pneumatic-hydraulic piston assembly 104, will be moved to its vertically uppermost position against the bias of the coil spring 142. In this position the piston end portion 108 of the pneumatic piston head 106 will be moved into stopping engagement with the lower end 143 of an elongated, vertically extending hydraulic piston housing 144 which is a part of a hydraulic piston housing assembly 145 to be described. See FIGS. 1, 4 and 5.

The pneumatic piston structure 104*a* includes an air popit valve assembly 146 connected to the piston head 106 and which is actuable to block the exhaust of pneumatic pressure from the cavity 100 by selective engagement with the tapered sealing bore portion 132. As can be best seen in FIG. 4, the popit valve assembly 146 is supported at the lower end of the pneumatic piston head 106. The air popit valve assembly 146 includes a cylindrical housing 148 which has a connecting portion 152 threadably secured to a threaded portion of an axial bore 154 through the pneumatic piston head 106. A popit member 156 is threadably connected to the outer end of a support sleeve 158. The support sleeve 158 has a reduced diameter portion 159 terminating in an enlarged end flange 160 by which it is slidably supported within the cylindrical housing 148. The reduced diameter portion 159 extends out through a reduced diameter opening at the lower end of the popit valve housing 148. In this condition the popit member 156 is located outside of the cylindrical housing 148 and has enlarged popit head 162 at its lower end. The popit head 162 has a generally hemispherically shaped outer surface which is adapted to matingly engage the tapered sealing bore portion 132 to effectively close the exhaust path through bore 130 to thereby block the exhaust of air through the exhaust bore 105. A coil spring 164 is resiliently connected to the support sleeve 158 at a reduced diameter neck portion below the flange 160 for movement with the support sleeve 158 and for engagement with the vertically lower end of the housing 148 when the popit member 156 has been raised with the popit head 162 out of engagement with the tapered sealing bore portion 132. In this regard, the length of the coil spring 164 is selected to maintain the popit head 162 at a desired distance beyond the lower end of the housing 148 when not engaged with the tapered bore portion 132. This distance is selected to set the desired time and travel of the pneumatic, hydraulic piston assembly 104 over which the popit head 162 will travel for engagement with the tapered bore portion 132 whereby the exhaust of air from and hence reduction of pressure in the pneumatic cylinder cavity 100 will be blocked. The cyclic alternation between the air pressure in the cavity 100 when blocked from exhaust and when open to exhaust provides the desired oscillation of pneumatic-hydraulic piston assembly 104 to thereby pump hydraulic fluid into the cylinder cavity 46 to actuate the pull piston 28 to set a fastener in the manner described.

The pneumatic-hydraulic tool 10 has a trigger assembly which includes a manually actuable trigger member 166 which is slidably secured to the vertically upper portion of the neck 88 of the main housing 84. At the same time a valve actuating rod 168 has a downwardly extending elongated arm portion 170, which is slidably supported for reciprocation within the main housing 84, and extends downwardly from the trigger member 166 substantially to the end cap 110. The upper end of the arm portion 170 terminates in an outwardly extending, upwardly angulated tab 171 which is located proximate to a central, transverse actuating rib 173 in the trigger member 166. An actuating arm portion 172 extends transversely from the lower end of the elongated arm portion 170 and terminates in an upwardly extending finger portion 174 which is located in close proximity to the ball seal 138.

As noted the valve actuating rod 168 is substantially totally located within the main housing 84. An upper section of the arm portion 170 is slidably supported against a transversely extending inner wall section 169 in the main housing 84.

Now to actuate the tool 10, the operator simply grips the tool 10 at the neck or handle portion 88 and pulls the trigger member 166 inwardly. This moves the rib 173 into engagement with the angulated tab 171 causing the valve actuating rod 168 and finger portion 174 to move upwardly. Now the finger portion 174 moves the ball seal 138 upwardly against the bias of the spring 140 to unseat it from the exhaust bore 105 whereby the pneumatic pressure in the cavity 100 is exhausted. See FIG. 1*a*. As this occurs the bias on the spring 142 is now sufficient to move the pneumatic piston structure 104*a* downwardly to move the popit head 162 into sealing engagement with the tapered sealing bore portion 132. This movement of the pneumatic piston structure 104*a* may continue until the flange 160 of the popit support sleeve 158 is moved upwardly into engagement with a damper plate 175. The damper plate 175 can be made of a generally resilient plastic material to minimize any impact loads upon engagement with the flange 160. A typical plastic material can be a nylon with a fiber glass filler. With the exhaust bore 105 closed, the magnitude of air pressure in the pneumatic cylinder cavity 100 rises to a magnitude at which the bias of spring 142 is again overcome whereby the pneumatic piston structure 104*a* is now moved vertically upwardly in a power stroke. However, the popit head 162 remains seated until the flange 160 is engaged by a reduced diameter shoulder 179 located within the housing 148. This assists in providing a preselected distance for upward movement of the pneumatic piston structure 104*a* before the popit head 162 is unseated and the cavity 100 is open to exhaust through the valve assembly 136. Now the popit head 162 will be unseated and the cycle will then be reversed. However during the cycle, the pneumatic-hydraulic piston assembly 104 on the vertical upward power stroke does not reach its uppermost idle stop position in which the end portion 108 of the pneumatic piston head 106 engages the lower end 143 of the hydraulic piston housing 144 in response to pneumatic pressure.

In this regard the restriction created by the reduced diameter inlet bore 116 is selected to control the rate of rise of pneumatic pressure in cylinder cavity 100 to thereby slow the speed of the upward stroke of the hydraulic piston structure 104*b* during the pressurization of the hydraulic fluid to avoid shock loads and the like.

At the same time, the restriction of the inlet bore 116 facilitates the speed of exhaustion of air pressure from the cavity 100 whereby the downward movement of the pneumatic piston structure 104*a*, and the pneumatic-hydraulic piston assembly 104, by the spring 142 is generally not impeded by full air flow from the pressure source 122 into the cavity 100. In this regard, the popit head 162 is seated against the tapered sealing bore portion 132 of exhaust through bore 130 before the pneumatic hydraulic piston assembly 104 has reached the end of its downward stroke. At the same time the restriction of inlet bore 116 also assists the return spring 142 in limiting the rate of upward return movement of the pneumatic piston structure 104*a* and reduces shock load and noise. This spaces the piston end portion 108 approximately a preselected distance Pn (see FIG. 1*a*) from the lower end 143 which serves an operational function to be described while at the same time avoiding vibrational impact loads and excessive wear. Thus the pneumatic piston structure 104*a* will reciprocate over a total distance Ph, (see FIG. 1*a*). The air pressure in the cavity 100 also acts on the popit head 162 to maintain it seated against tapered sealing bore portion 132 until engagement of the flange 160 with the shoulder 179. This then provides a lost motion type structure during initial movement of the pneumatic piston structure 104*a* in the upward stroke. As will be seen it is these series of reciprocations of the pneumatic piston structure 104*a* over the distance Ph which results in the pumping of hydraulic fluid under pressure into the cylinder cavity 46 during the power strokes to cause the pulling action of the pull piston 28.

It should be noted, however, that if the tool 10 were not connected to the pneumatic pressure source 122, the pneumatic-hydraulic piston assembly 104 would be in the position as shown in FIG. 1 a regardless of whether the trigger member 166 was actuated or not.

The pneumatic-hydraulic piston assembly 104 has the hydraulic piston structure 104*b* connected to the pneumatic piston head 106. The hydraulic piston structure 104*b* has an elongated hydraulic piston 177 which has a cylindrical housing section 178 which is connected to the pneumatic piston head 106 by a flange 180 at its lower end portion 181. See FIG. 4. The flange 180 is located in the bore 154 in engagement with a reduced diameter stepped portion at the upper end of the bore 154. The housing section 178 is sealed at its lower end by a plug 184 threadably secured therein. The damper plate 175 is located in the bore 154 in engagement with the plugged lower end of the housing section 178. The hydraulic piston structure 104*b* and damper plate 175 are secured in the bore 154 by the threaded connection of the popit valve housing 148 therein.

It can be seen, as noted, that the pneumatic-hydraulic piston assembly 104 includes the hydraulic piston structure 104*b* and the pneumatic piston structure 104*a*. Here some of the elements of the hydraulic piston structure 104*b* which are secured to the pneumatic piston head 106 operate as a common piston rod for the pneumatic piston head 106 of the pneumatic piston structure 104*a* and for the hydraulic piston 177 of the hydraulic piston structure 104*b*. Thus the designation pneumatic-hydraulic piston assembly 104 is appropriately applied to this interconnected structure.

Figure 4:
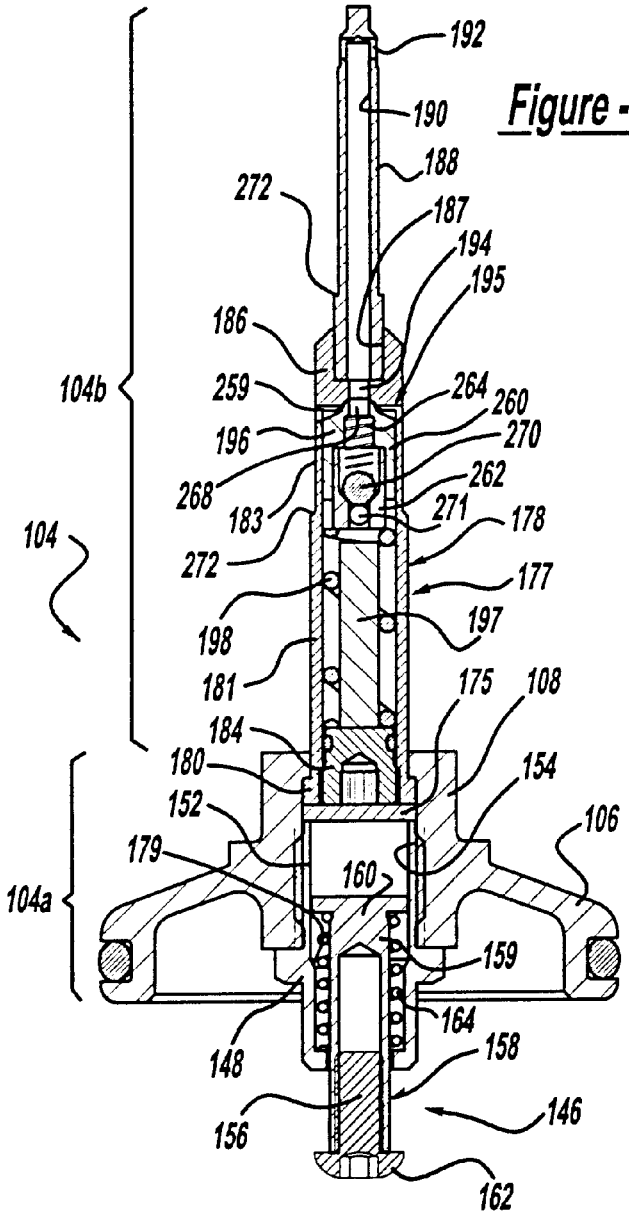
FIG. 4 is an elevational, sectional view to enlarged scale of a portion of the pneumatic-hydraulic piston assembly of the tool of FIG. 1 including a pneumatic piston structure as interconnected with a hydraulic piston structure.

Looking now to FIG. 4, the housing section 178 has a reduced diameter upper portion 183 which terminates at its upper end in a head portion 186 which has a cavity 187 in its outer end in which an elongated piston valve rod 188 is secured. The piston valve rod 188 has a central vertical bore 190 which is communicated with a radial cross bore 192 at its upper end. The rod bore 190 at its lower end is in communication with an axial bore 194 at the end of the cavity 187 which can communicate with the inside of the cylindrical housing section 178. A high pressure relief valve 195, which serves a purpose to be described, includes a valve head 196 which is resiliently supported by a coil spring 198 and has a tapered valve boss at its upper end biased into sealing engagement with an enlarged tapered valve seat at the lower outer end of the axial bore 194. The valve head 196 is in clearance with the confronting internal surface of the housing section 178 to provide a fluid passage for a purpose to be seen. A support pin 197 is supported on the plug 184 and extends axially through the coil spring 198 to a point spaced from the bottom of the relief valve head 196. The support pin 197 limits the downward movement of the valve head 196 in response to fluid pressure for pressure relief to be described.

Figure 5:
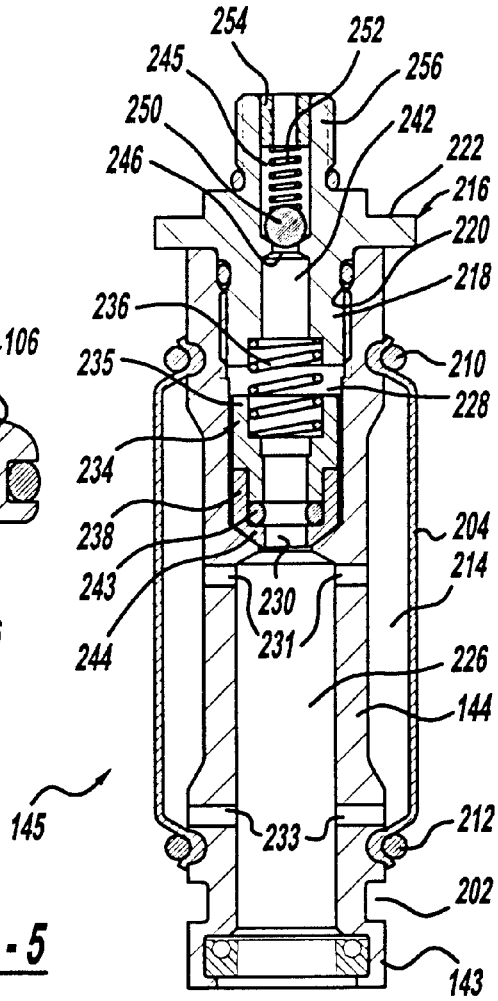
FIG. 5 is an elevational, sectional view to enlarged scale of the hydraulic piston housing assembly of the hydraulic pump section of the tool of FIG. 1.

The hydraulic piston structure 104*b* is operatively connected to the piston housing assembly 145, the details of which can be best seen in FIG. 5. Looking now to FIGS. 1, 1*a* and 5, the piston housing assembly 145 is in a fixed position in the neck or handle portion 88 of the main housing 84, and includes the elongated piston housing 144. The housing 144 has an annular slot 202 at its lower end 143 adapted to be supported on an annular ledge 206 in the main housing 84 by which the housing assembly 145 is held in the fixed position at the inside of the main housing 84.

An elongated, elastic, cylindrical bladder 204 extends vertically around a portion of the outer surface of the housing 144 and is held in sealed relationship in transversely spaced grooves in the outer surface by resilient rings 210, 212 at the opposite ends. The bladder 204 defines a fluid reservoir cavity 214 with the confronting surface of the housing 144 with the reservoir cavity 214 having a preselected volume for holding the necessary amount of hydraulic fluid to be pressurized for actuating the pull piston assembly 20.

The housing assembly 145 has a connector member 216 which has a bottom portion 218 threadably connected to a threaded bore portion 220 at the upper end of the housing 144 with a flange 222 on the connector member 216 adapted to be seated on the upper end of the housing 144. The connection between the bottom portion 218 and the bore portion 220 is hydraulically sealed by an annular seal.

The housing 144 has a reserve pressure cavity 226 at its lower end and a main pressure cavity 228 at its upper end which are in fluid communication with each other by way of a reduced diameter bore 230 having an enlarged tapered valve seat at the lower side of the main pressure cavity 228. The reserve pressure cavity 226 is in communication with the reservoir cavity 214 by an upper cross bore or port 231 and a lower cross bore or port 233 extending radially through the housing 144. The upper cross bore 231 is located generally midway along the reservoir cavity 214 and near the top of the reserve pressure cavity 226 while the lower cross bore 233 is located proximate to the lower end of the reservoir cavity 214 and near the bottom of the reserve pressure cavity 226.

A fluid return valve assembly 234 is located in the main pressure cavity 228 and includes an upper cylindrical casing 235 with a tubular valve head 238 connected to its lower reduced diameter end portion. An annular hydraulic seal 243 seals the bore 230 with the piston valve rod 188 which is reciprocably mounted therein as shown in FIGS. 1, 1*a*, 6 and 7. The return valve head 238 terminates at its lower end in a tapered nose portion 244 adapted to matingly, sealing engage the tapered valve seat of bore 230. However, the upper cylinder casing 235 and the straight portion of the valve head 238 are in clearance relationship with the confronting surface of the main pressure cavity 228 to define a fluid passage for a purpose to be described. The return valve assembly 234 is biased downwardly by a coil spring 236 to maintain resilient, closed engagement of the nose portion 244 against the tapered valve seat. The opposite ends of the coil spring 236 are located in confronting counterbores in the bottom portion 218 of connector member 216 and upper portion of the casing 235, respectively.

The counterbore in bottom portion 218 is at the lower end of a reduced diameter bore portion 242 of a bore extending through the connector member 216 and which includes the counterbore. The reduced diameter bore portion 242 is connected to a similarly sized upper bore portion 245 by a reduced diameter valve seat bore 246 which has a tapered upper valve seat. An access ball valve 250 is located in the upper bore portion 245 and is resiliently urged into sealing engagement with the tapered valve seat of bore 246 by a coil spring 252. The upper end of spring 252 is in engagement with a cylindrical end plug 254 which is press fitted into the upper end of the upper bore portion 245. As can be seen in FIGS. 1 and 1*a* the piston housing assembly 145 is adapted to be connected to the hydraulic cylinder housing 24 of the pull piston assembly 20 by a threaded connection between a reduced diameter end portion 256 of the connector member 216 and a through bore 258 in the cylinder housing 24 in communication with the cylinder cavity 46. An annular seal hydraulically seals the connection. As will be seen in this way hydraulic fluid under pressure can be communicated to the cylinder cavity 46 from the piston housing assembly 145.

The hydraulic piston structure 104*b* also includes a ball check refill valve 260. The ball check refill valve 260 includes a sleeve 262 which is located within a counterbore in the lower end of the valve head 196. A coil spring 264 has an upper end located in a bore portion in a through bore 268 in the valve head 196 and biases a ball seal 270 into sealing engagement with a tapered valve seat at the lower end of an enlarged bore portion in the sleeve 262. A radial cross bore 271 is located below the ball seal 270 to provide a fluid path to the through bore 268 in the event the valve head 196 is seated upon the support pin 197 blocking the bottom of the through bore 268.

Figure 6:
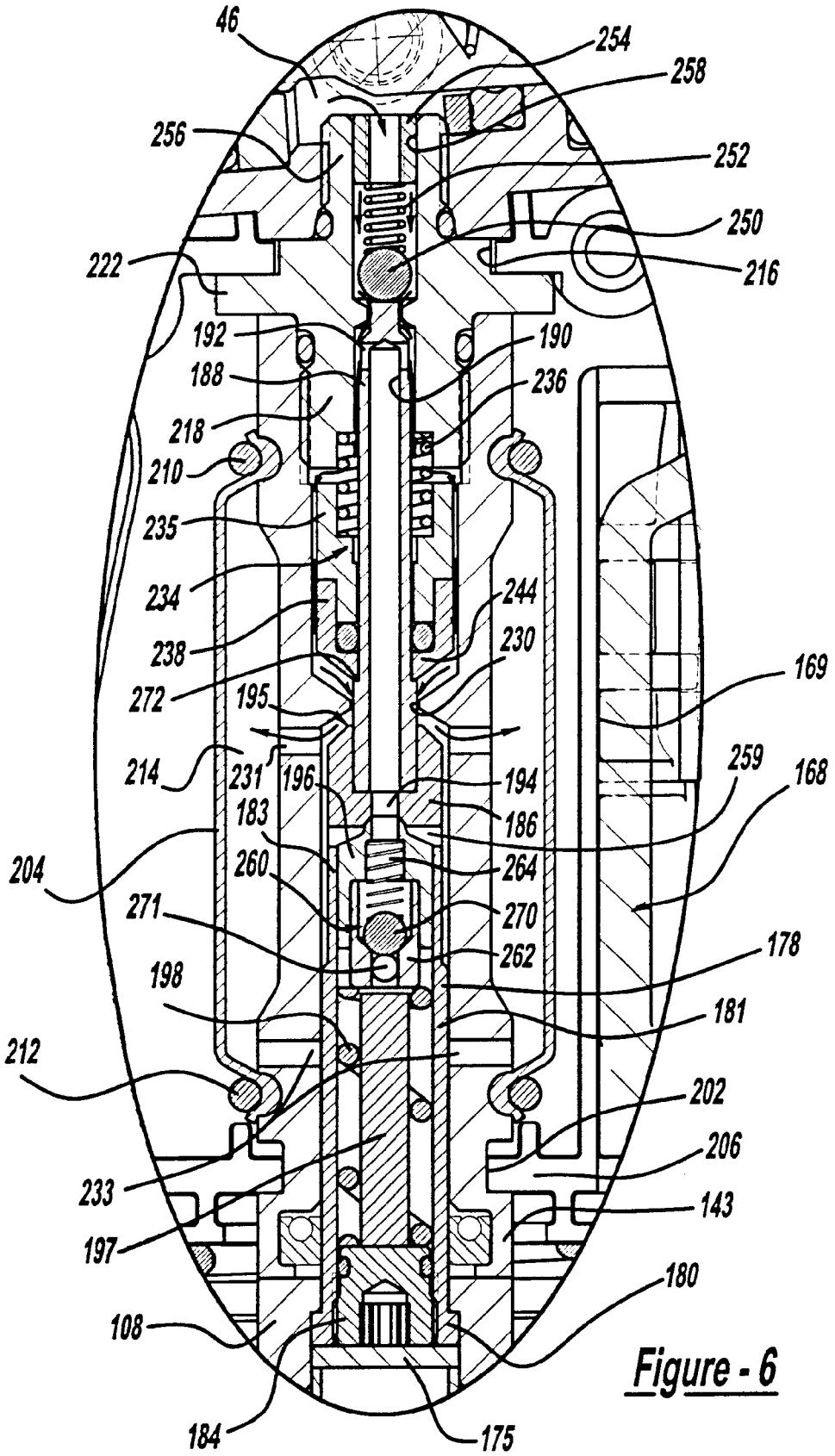
FIG. 6 is a fragmentary view to enlarged scale of the hydraulic piston structure with the axially in-line valve construction and taken generally in the area of the Circle 6 in FIG. 1 depicting the piston structure and valve construction with the tool in the idle state with the flow of hydraulic fluid in moving for the return or idle state shown in lines with arrows indicating the direction of flow of the fluid for return.

As noted, FIGS. 1 and 6 show the pneumatic-hydraulic tool 10 in its idle or deactuated condition. Here the trigger member 166 has not been actuated and the ball check exhaust valve assembly 136 is in its closed position, i.e. exhaust bore 105 closed by the ball seal 138. At the same time, the pneumatic cylinder cavity 100 is pressurized by air pressure from the pneumatic pressure source 122. The pneumatic-hydraulic piston assembly 104 is thereby moved to its vertically uppermost position against the bias of the coil spring 142 with the pneumatic piston end portion 108 in engagement with lower end 143 of the piston housing 144. In this condition, the upper end of the piston valve rod 188 will be in engagement with the ball valve 250 to maintain it off the associated valve seat while the return valve head 238 is unseated by engagement with an enlarged shoulder 272 at the lower end of the piston valve rod 188. In this way, the cylinder cavity 46 in the hydraulic cylinder housing 24 is open and in fluid communication with.the reservoir cavity 214. In this condition the return spring 74 will maintain the pull piston 28 in its returned or deactuated condition.

To actuate the tool 10, the operator simply pulls the trigger member 166 inwardly. As can be seen in FIG. 1*a*, this then moves the associated actuating rod 168 upwardly whereby the finger portion 174 unseats the ball seal 138. Now the pressurized air in the pneumatic cylinder cavity 100 is exhausted through the open exhaust bore 105 causing the pressure in the cavity 100 to drop. As this occurs, the bias of the spring 140 becomes sufficient to move the pneumatic-hydraulic piston assembly 104 with the pneumatic piston head 106 vertically downwardly. The piston head 106 moves downwardly a preselected distance bringing the popit head 162 of the popit member 156 into engagement with the tapered sealing bore portion 132. This movement will continue until the popit member 156 is brought to its end position with the flange 160 in engagement with the damper plate 175. It can be seen from FIG. 1 that after movement of the piston head 106 downwardly a short distance the hydraulic piston structure 104*b* is moved downwardly and the piston valve rod 188 is moved out of engagement with the ball valve 250. Now the ball valve 250 is urged into engagement with the valve seat by the spring 252 to close the cylinder cavity 46. It can be seen from FIG. 1*a* that in its lowermost position, the hydraulic piston structure 104*b* has moved the piston valve rod 188 a preselected distance from engagement with the ball valve 250. As will be seen that preselected distance is essentially determined by the stroke Ph of the pneumatic piston structure 104*a* for compression of hydraulic fluid.

Figure 7:
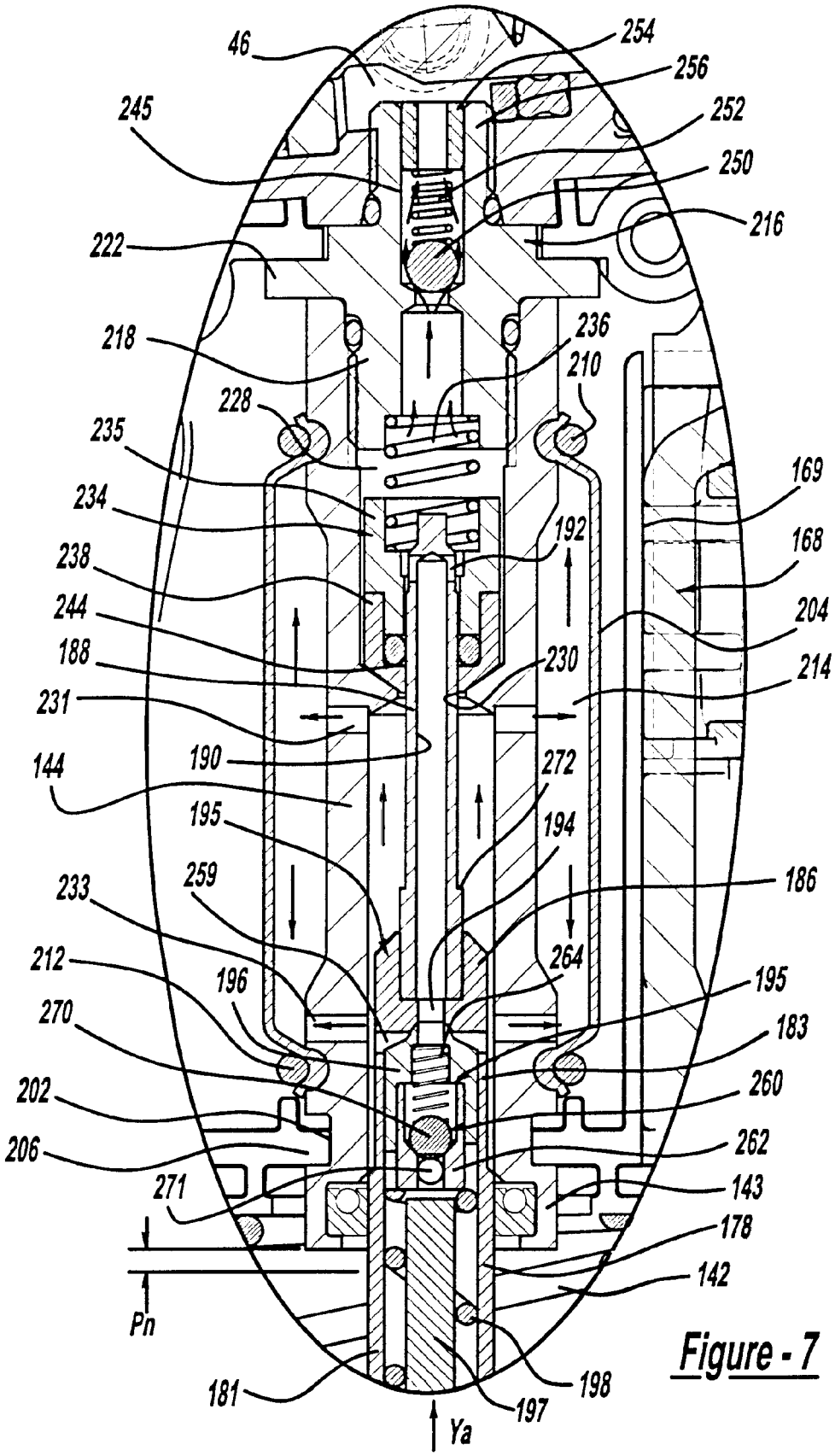
FIG. 7 is a fragmentary view to enlarged scale similar to that of FIG. 6 but taken generally in the area of the Circle 7 in FIG. 1*a* depicting the piston structure and valve construction with the tool in the actuated, pressurized state during the pressure stroke of the piston structure with the flow of hydraulic fluid during actuation shown in lines with arrows indicating the direction of flow of the fluid during pressurization and with the direction of movement of the pneumatic-hydraulic piston assembly shown with a vertical line Ya with an arrow.

As noted, FIG. 6 shows the tool 10 in its deactuated or return condition with fluid in the cylinder cavity 46 of the nose assembly section 16 being returned to the reservoir cavity 214 while FIG. 7 shows the tool 10 during the pressure stroke with fluid under pressure being moved into the cylinder cavity 46 to energize the pull piston 28. In both FIGS. 6 and 7 the flow of fluid is shown in lines with arrows indicating the direction of flow of the fluid. Looking now to FIG. 7, the valve construction is shown in its state for transmitting pressurized hydraulic fluid to the cylinder cavity 46 in the nose assembly section 16. As the pneumatic-hydraulic piston assembly 104 moves upwardly during reciprocation in response to the pneumatic pressure in the cavity 100, the hydraulic piston structure 104*b* is moved upwardly in the direction Ya moving the piston valve rod 188 further into the main pressure cavity 228. As this occurs the available volume in the main pressure cavity 228 in the housing 144 is reduced resulting in the fluid therein being pressurized. The pressurized fluid in the main pressure cavity 228 moves the ball valve 250 upwardly against the spring 252 away from the valve seat whereby pressurized fluid will flow through the upper bore portion 245 and into the cylinder cavity 46. This then applies hydraulic pressure to the piston head 32 to initiate its rearward movement to apply the pull stroke on the hydraulic piston rod 34. At the same time the upward movement of the housing section 178 of the piston structure 104*b* reduces the volume in the reserve cavity 226 moving hydraulic fluid through the cross bores 231 and 233 into the reservoir cavity 214 to increase the pressure therein with the elastic bladder 204 resiliently expanding to accept the additional fluid.

Figure 7A:
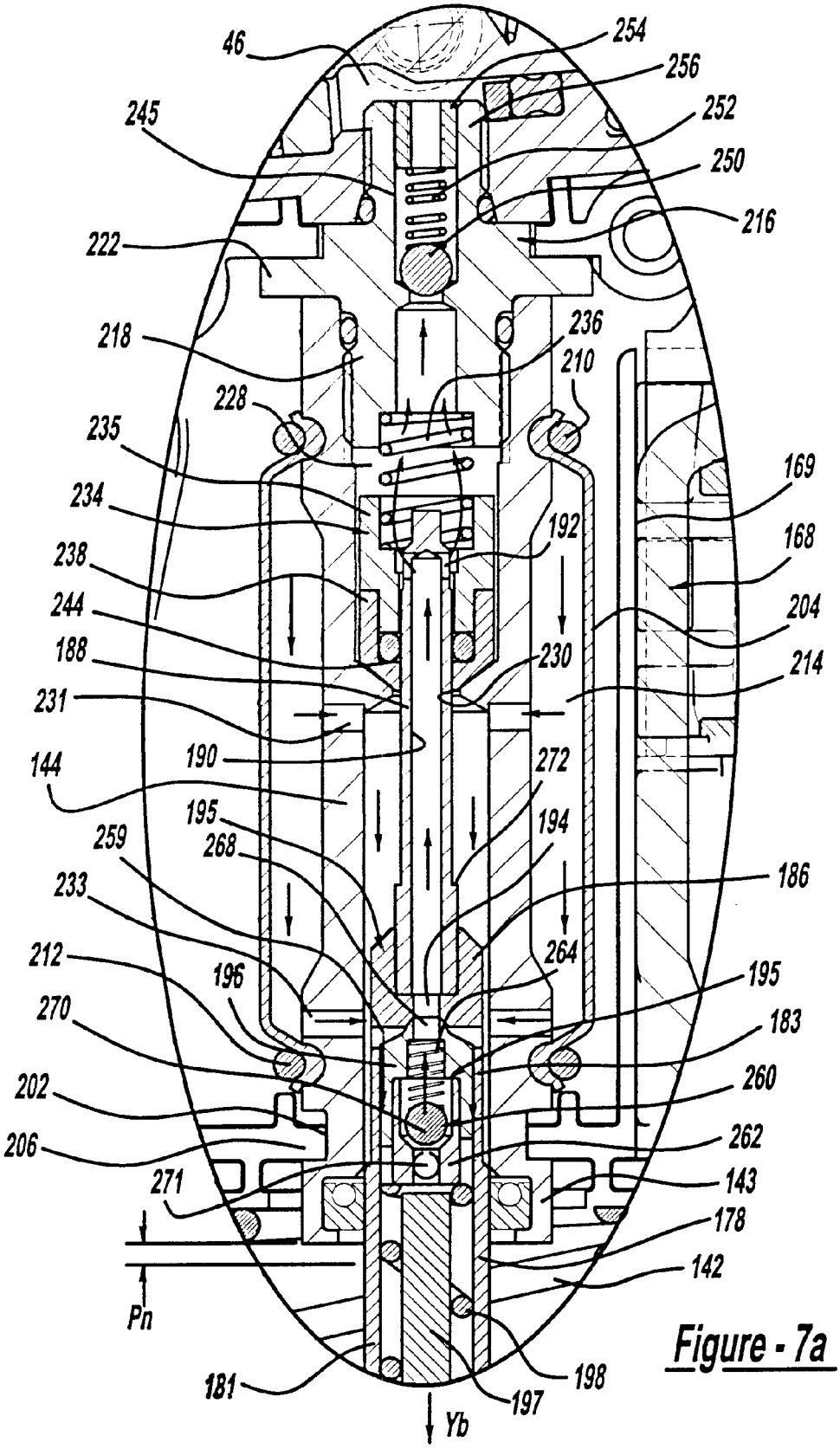
FIG. 7*a* is a fragmentary view similar to FIG. 7 depicting the piston structure and valve construction with the tool in the actuated state during the return, non-pressurized stroke of the piston structure with the flow of hydraulic fluid shown in lines with arrows indicating the direction of fluid flow and with the direction of movement of the pneumatic-hydraulic piston assembly shown with a vertical line Yb with an arrow.

The condition of the hydraulic piston structure 104*b*, the housing assembly 145 and the valve construction during the return stroke of the pneumatic-hydraulic piston assembly 104 caused by the pneumatic piston structure 104*a* during its reciprocation is shown in FIG. 7*a*. The direction of flow of hydraulic fluid with the tool 10 actuated on the return stroke is shown by lines with arrows. Now as the pneumatic piston structure 104*a* is moved downwardly in the direction Yb, the hydraulic piston structure 104*b* is moved downwardly. At the same time the downward movement of valve rod 188 will result in the volume of the main pressure cavity 228 increasing whereby the pressure therein will decrease to initiate the creation of a relative vacuum. The ball valve 250 will be returned to the valve seat by the spring 252 to close access to the cylinder cavity 46 to maintain the fluid and pressure level in the cylinder cavity 46. At the same time the pressure in the reserve cavity 226 and the reservoir cavity 214 while decreasing will be maintained substantially higher and will cause the ball seal 270 of the refill valve 260 to be unseated. Now hydraulic fluid from the reservoir cavity 214 will flow into the reserve cavity 226 and through the clearance between the valve head 196 and the confronting surface of the housing section 178, through the cross bore 271 into the through bore 268 and into the central rod bore 190 of the piston valve rod 188 and out through the cross bore 192 into the main pressure cavity 228. This then refills the main pressure cavity 228 with hydraulic fluid for pressurization into the cylinder cavity 46 upon the next upward pressure stroke of the pneumatic piston structure 104*a* during reciprocation. This cycle continues while the installation tool 10 is actuated until the installation of the fastener is completed. Upon deactuation of the installation tool 10, it will be returned to its idle condition as shown in FIGS. 1 and 6 and as previously described.

At the end of the power or pressure stroke, as the pneumatic pressure drops in the pneumatic cylinder cavity 100 the pneumatic-hydraulic piston assembly 104 will be moved downwardly by the spring 142 to a position at which the exhaust through bore 130 is again closed and after which time the cycle repeats itself. The reduction in pneumatic pressure is facilitated by the reduced diameter inlet bore 116 which acts to restrict the flow of air from the pneumatic pressure source 122 back into the pneumatic cylinder cavity 100 at a preselected rate. It should be noted, however, that since the pneumatic-hydraulic piston assembly 104 on the pressure stroke does not reach its full uppermost position as in idle, the piston valve rod 188 will not engage the access ball valve 250 whereby the hydraulic pressure in the cylinder cavity 46 will be maintained during the reciprocating cycle of the pneumatic-hydraulic piston assembly 104. Thus the hydraulic piston head 32 will continue to be moved rearwardly moving the piston rod 34 to close the jaws 54 onto the fastener pin and exert the noted relative axial pulling force to set the fastener. Once the fastener is set the operator returns the tool 10 to its deactuated idle condition by releasing the trigger member 166 whereby the ball seal 138 is again seated to close the exhaust port or bore 105.

Figure 7B:
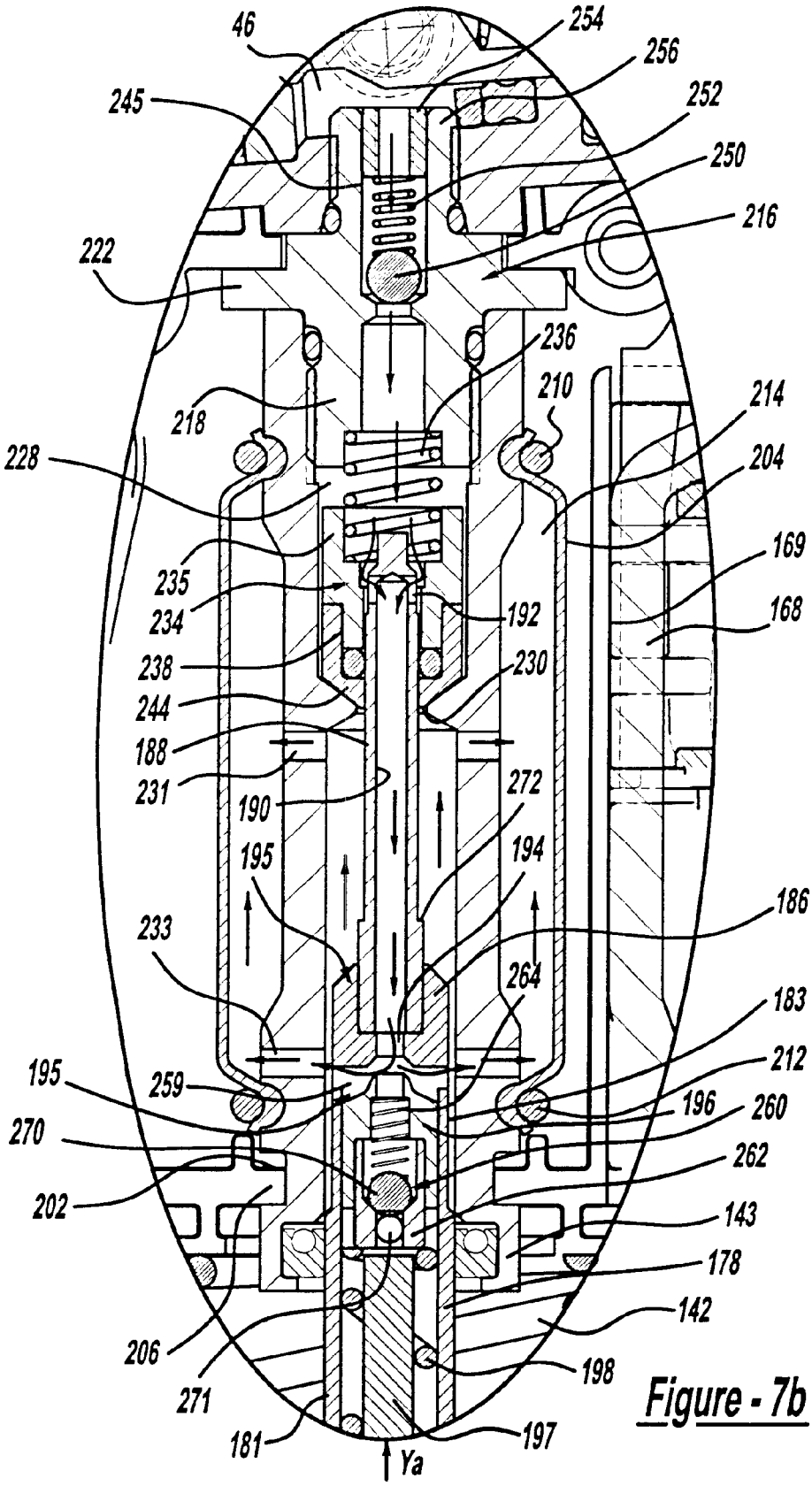
FIG. 7*b* is a fragmentary view similar to FIG. 7 depicting the piston structure and valve construction with the tool in the actuated state with a high pressure relief valve actuated to prevent blockage of hydraulic fluid flow and with the direction of movement of the pneumatic-hydraulic piston assembly shown with a vertical line Ya with an arrow of the direction.

Looking now to FIG. 7*b*, as noted, the hydraulic piston structure 104*b* includes a high pressure relief valve 195. In the event the piston head 32 of the pull piston 28 of the.nose assembly section 16 is blocked from movement and the pneumatic-hydraulic piston assembly 104 is still actuated to move in the direction Ya to compress the hydraulic fluid in the main pressure cavity 228, the relief valve 195 is operable in response to the increase in hydraulic pressure to a preselected magnitude above the normal operating pressure in the main cavity 228 to move the valve head 196 away from the tapered valve seat against the bias of the spring 198. With the relief valve 195 open hydraulic fluid is released from the main cavity 228, through the cross bore 192 and into the central bore 190, through axial bore 194 and then through a radial cross bore 259 in the housing section 178 just below the head portion 186 and into the reserve cavity 226 and then into the reservoir cavity 214 to thereby relieve the pressure. This magnitude of pressure and fluid flow from the main cavity 228 is transmitted to the valve head 196 through the central bore 190 in the piston valve rod 188. This inhibits excessive pressure build up and/or stoppage of the pneumatic-hydraulic piston assembly 104. The direction of flow of hydraulic fluid in pressure relief is shown in FIG. 7*b* by lines with arrows. Now when the operator releases the trigger member 166, the tool 10 can be brought back into its deactuated condition as shown in FIGS. 1 and 6.

In this condition, the pneumatic-hydraulic piston assembly 104 will be returned to its uppermost position with the pneumatic piston end portion 108 in engagement with the lower end 143 of the housing 144. This results in the piston valve rod 188 being returned to its uppermost position to engage and unseat the access ball valve 250. At the same time the shoulder 272 on the piston valve rod 188 will have engaged the valve head 238 to unseat it. Now the hydraulic fluid in the cylinder cavity 46 will be returned to the reservoir cavity 214 by the force of the return spring 74 moving the pull piston 28 to its forward, returned position. The fluid will flow back through the upper bore portion 245 through the bore 246, into the reduced diameter bore portion 242, around the piston valve rod 188 and casing 235, then past the return valve head 238 which is unseated then around the clearance between the bore 230 and the confronting surface of the piston valve rod 188 and through cross bores or ports 231 and into the reservoir cavity 214. This can best be seen in FIG. 6 with the direction of flow of hydraulic fluid being shown by lines with arrows. The upper surface of the head portion 186 is tapered to facilitate the clearance for return flow.

As can be seen, the hydraulic valving construction of the hydraulic pump section 14 as described above is essentially in axial alignment. Thus the pressure relief valve 195, the return valve 234, the access ball valve 250 and the refill valve 260 are all in axial alignment. In addition, the hydraulic valves are also in axial alignment with the pneumatic valving including the exhaust valve assembly 136 and the popit valve assembly 146 with the exhaust bore 130. This facilitates manufacture, maintenance and/or repair of the hydraulic pump section 14 and also facilitates the tool 10 being of a compact and relatively lightweight structure.

In this regard, the two piece structure of the main housing 84 facilitates its manufacture from a lightweight plastic material and also to facilitate formation of an ergonomic contour for gripping by the operator. Likewise the pneumatic cylinder structure 96 can also be made of a lightweight plastic material. Such plastic materials include materials sold under the trade names DELRIN and CELCON.

Another form of the present invention is a manual-hydraulic tool structure which also has an in-line valve structure having numerous ones of the noted advantages of the pneumatic-hydraulic tool 10. Thus looking now to FIGS. 9–19 a manual-hydraulic tool 300 is shown having an in-line valve structure similar to that of the pneumatic-hydraulic tool 10. Thus in the description of the manual-hydraulic tool 300 it will be seen that there are numerous components and functional features similar to those of the pneumatic-hydraulic tool 10.

Figure 10:
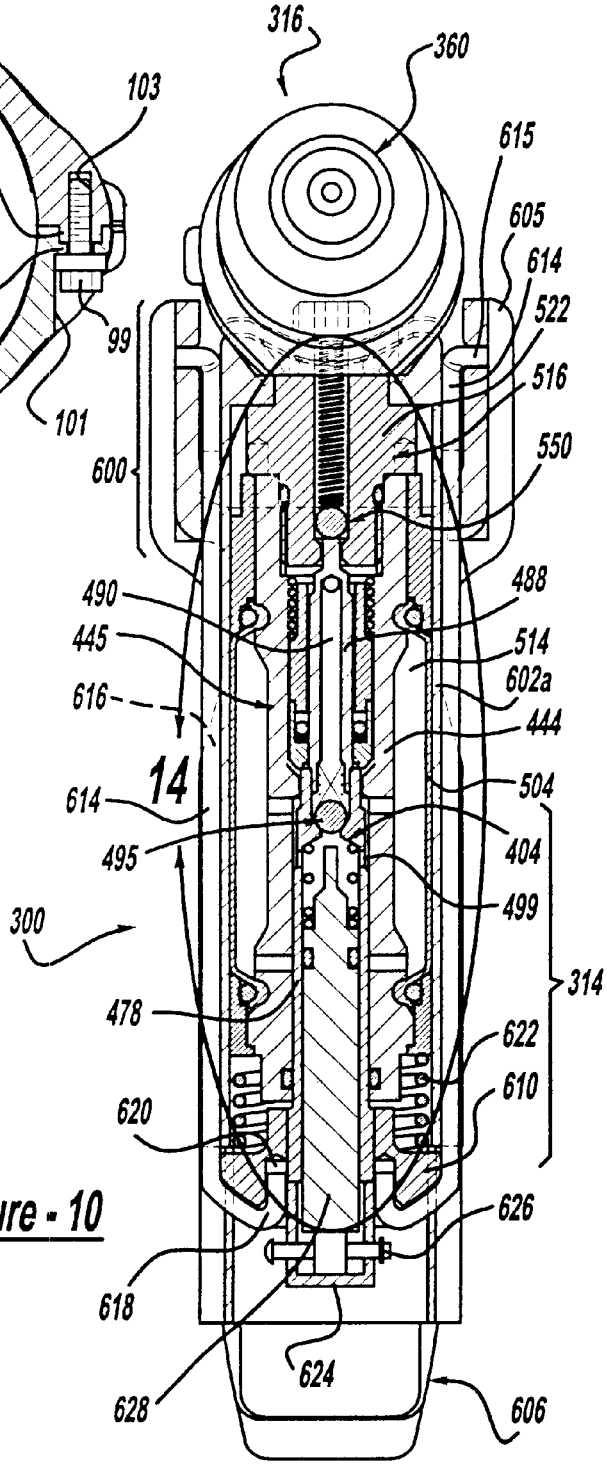
FIG. 10 is an end elevational and partially sectional view of the installation tool of FIG. 9 depicting the tool at its non-energized state at the end of its energization and in a condition for fluid pressure release and return to idle and with the gripping cover on the main housing removed.
Figure 9:
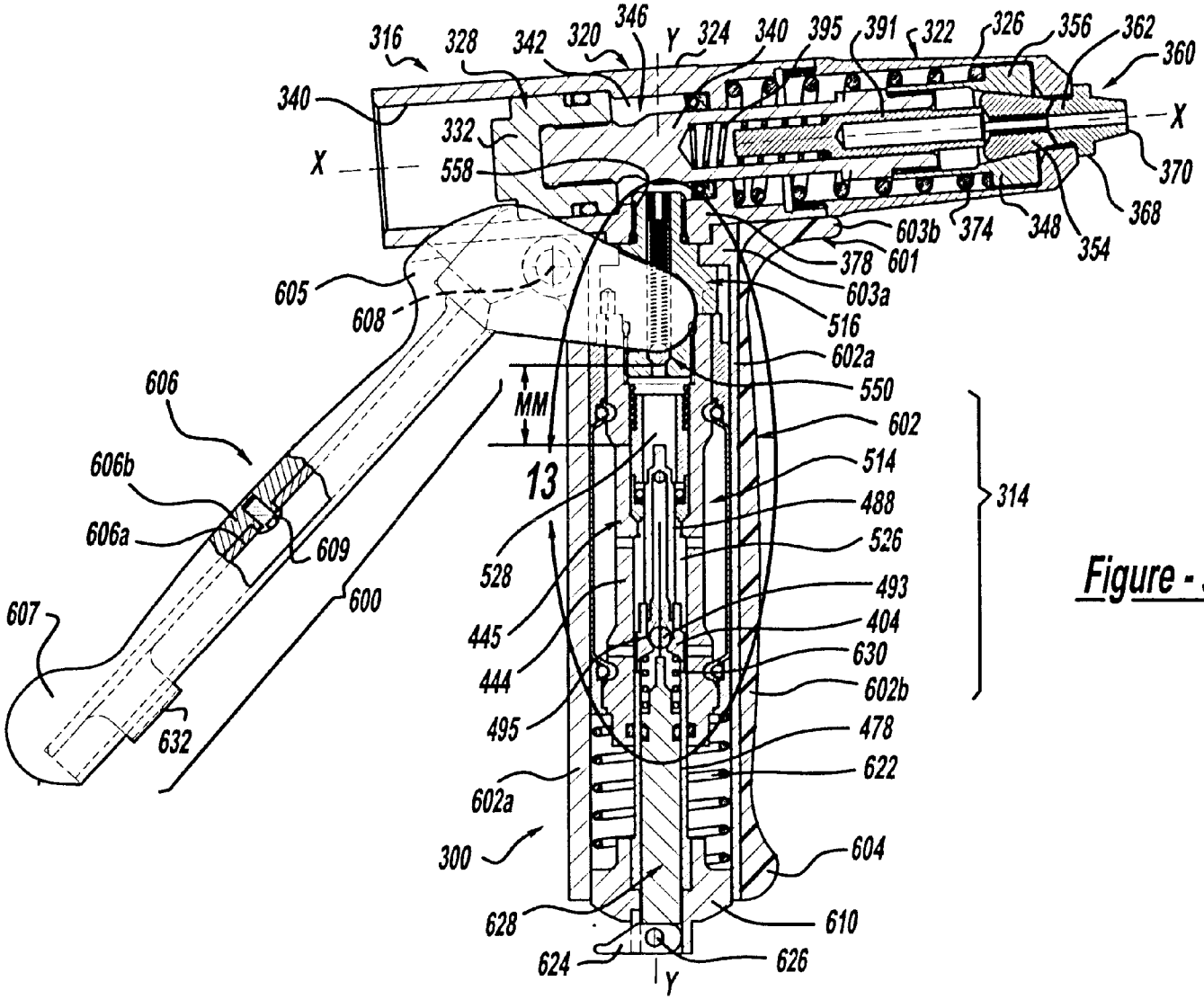
FIG. 9 is a side elevational, sectional view of a manual-hydraulic installation tool embodying features of the present invention and including a hydraulic pump section with in-line valves and with the tool in a condition for the beginning stage of its energized or pull state.
Figure 11:
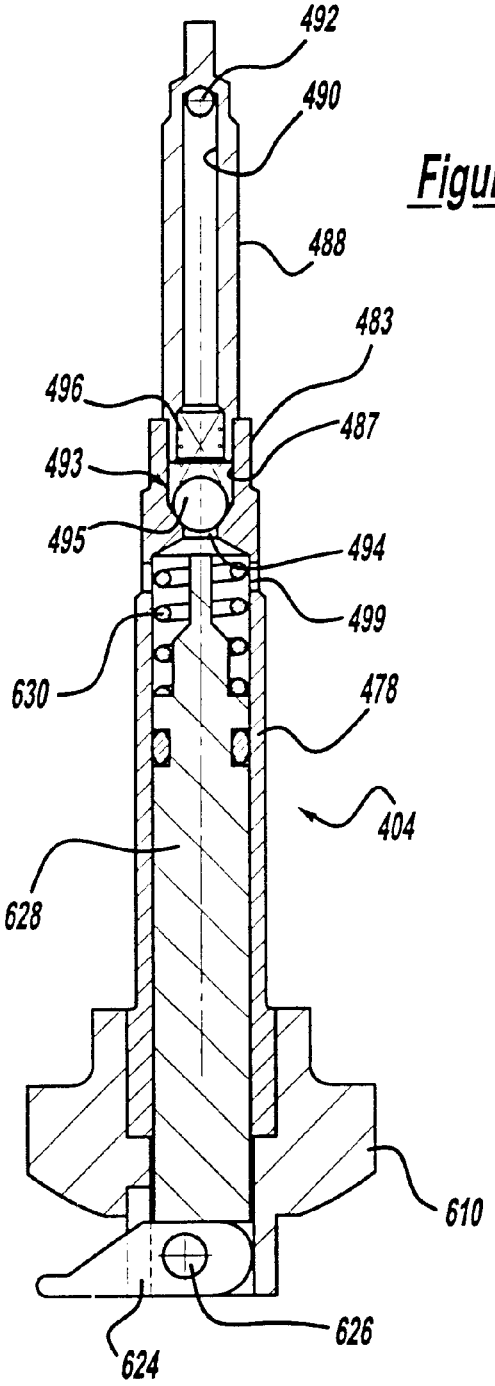
FIG. 11 is an elevational, sectional view to enlarged scale of the hydraulic piston structure of the tool of FIG. 9.

Looking now to FIGS. 9 and 10 the manual-hydraulic fastener installation tool 300 is shown and includes a manual pump section 600, a hydraulic pump section 314 and a hydraulically actuated nose assembly section 316. The hydraulic pump section 314 is operatively connected with the manual pump section 600 such that manual actuation of the manual pump section 600 by the operator will in turn cause actuation of the hydraulic pump section 314 to provide fluid at a relatively high hydraulic pressure to the nose assembly section 316. A typical hydraulic pressure attained was around 11,000 psi. FIG. 9 shows the tool 300 in a condition for initiation of pressurized actuation, however, with the nose assembly section 316 in the condition to receive the pin of a fastener to be installed.

The nose assembly section 316 can be of a generally conventional construction for providing a relative axial pulling force to install pull type fasteners, as noted, in response to the hydraulic pressure from the hydraulic pump section 314. In this regard the nose assembly section 316 is substantially identical with the nose assembly section 16 except for the anvil member 360 which is somewhat different than the anvil member 60. Thus for purposes of brevity and simplicity all of the details of the elements of the nose assembly section 316 which are similar to those of the nose assembly section 16 have not been repeated here and such details are incorporated herein by reference. Thus the nose assembly section 316 includes a pull piston assembly 320 and an anvil assembly 322. The piston assembly 320 has a hydraulic cylinder housing 324 which has a cylinder cavity of a stepped construction including an enlarged diameter section 340 and a reduced diameter section 342.

The piston assembly 320 includes a pull piston 328 mounted in the cylinder cavity for reciprocating motion along a longitudinal axis X. Pull piston 328 has an enlarged hydraulic piston head 332 threadably connected to a reduced diameter piston rod 334. The piston head 332 is slidably supported in the enlarged diameter section 340 of the cylinder cavity.

The piston rod 334 extends through the reduced diameter section 342 of the cylinder cavity which is adapted to initially receive hydraulic fluid under pressure to effectuate a pull stroke of the piston 328. The piston rod 334 also extends axially through a front radial wall and into the anvil housing 326. In this regard, the reduced diameter section 342 and a portion of the enlarged diameter section 340 define a hydraulic pressure cylinder cavity 346.

The anvil assembly 322 includes an inner collet assembly 348. The outer anvil housing 326 is threadably secured at the outer end of the cylinder housing 324 thereby securing the anvil assembly 322 to the piston assembly 320. The collet assembly 348 is threadably secured to the outer end of the piston rod 334. Thus as pull piston 328 reciprocates along the X axis it will similarly reciprocate the collet assembly 348. The collet assembly 348 includes a plurality of gripping jaws 354 supported in an enlarged diameter boss 356 at the outer end of a collet housing 358. The jaws 354 are adapted to grip the pin of the fastener to be set. The anvil assembly 322 also includes an anvil member 360 having an inner portion 362 threadably secured to a bore at the outer end of the anvil housing 326 with an enlarged flange 368 adapted to engage the outer end of the anvil housing 326. The anvil member 360, unlike the anvil member 60, has a reduced diameter anvil nose portion 370 extending outwardly from the flange 368 of the anvil member 360. The nose portion 370 is adapted to engage the head of a fastener sleeve which head can be of a flush head construction. In addition the threaded inner portion 362 is shorter than the threaded inner portion 62 of anvil member 60. This permits the jaws 354 to extend partially into the bore at the outer end of the anvil housing 326. As noted these are essentially the only differences between the nose assembly sections 16 and 316.

The collet assembly 348 is normally biased to its forwardmost position when deactuated by a return coil spring 374. The jaws 354 have a generally frusto-conically shaped radially outer surface adapted to be matingly slidably supported in a frusto-conically shaped bore through the boss 356. The jaws 354 are formed with a plurality of gripping teeth on their radially inner surfaces. The jaws 354 are provided with radially inwardly tapered surfaces at their axially outer ends adapted to engage a mating, radially outwardly tapered section at the inner end of the inner portion 362 of the anvil member 360. The jaws 354 also have similar radially inwardly tapered surfaces at their axially inner ends adapted to engage the outer end of a reduced diameter jaw biasing rod 391. The bias rod 391 is slidably supported within a central bore in the piston rod 334 and a coil spring 395 engages the bias rod 391 biasing it axially outwardly to resiliently engage the confronting tapered surfaces of jaws 354. Thus with the nose assembly section 316 shown in a position prior to actuation as illustrated in FIG. 9, the engagement of the bias rod 391 with the tapered surfaces of jaws 354 will urge the inwardly tapered surfaces at the inner ends of jaws 354 into engagement with the tapered section at inner portion 362 of anvil member 360 and will thereby bias the jaws 354 radially outwardly to their open position. In this open position the end of the fastener pin with pull grooves can be readily moved through the jaws 354.

Now when the nose assembly section 316 is energized by hydraulic fluid pressure in cylinder cavity 346 the pull piston 328 will be moved axially rearwardly moving the collet assembly 348 rearwardly. As this occurs the jaws 354 will be moved radially inwardly from the engagement of the frusto-conical surfaces and against the bias of the bias rod 391 with the jaw teeth engaging the confronting surface of the fastener pin to exert a relative axial force between the fastener pin and the collar or sleeve by engagement therewith of the nose portion 370 of the anvil member 360. In the drawings, the pin and engagement with the jaws 354 have been omitted for purposes of simplicity and brevity.

The action applied between the collet assembly 348 and anvil member 360 results in a relative axial force applied to the fastener to set the fastener and whereby after it is set the frangible pull portion of the pin is severed under increased load. However, as noted, pull type fasteners without frangible pull portions or pull portions without pull grooves can also be installed with the tool 300. When this occurs the installation tool 300 is deactuated, in a manner to be described, whereby the nose assembly section 316 will return to the condition shown in FIG. 9. Now the jaws 354 will be biased by the return spring 374 to their opened position (as shown in FIG. 9) releasing the severed pintail or a nonseverable pintail such that it can be freely ejected from the nose assembly section 316.

The cylinder housing 324 has a base section 378 which is adapted to be seated upon an upper transversely extending platform portion 601 of a generally vertically extending, elongated housing assembly 602 whereby the nose assembly section 316 can be connected to the housing assembly 602. The housing assembly 602 is configured with a relatively circular cross-section formed as a handle to facilitate manual gripping by the operator.

The housing assembly 602 has a main housing 602*a* of a one piece cylindrical construction and which houses and/or supports the operative elements. The main housing 602*a* is made of a relatively rigid lightweight metallic material such as aluminum and terminates at its upper end in a platform support section 603*a* which is a part of the platform portion 601. However, in order to facilitate ergonomic gripping for manual action the housing assembly 602 includes an elastomeric housing cover 602*b* made of a material such as Nylon 6. See FIGS. 9, 18 and 19. The housing cover 602*b* extends for around 270° over the front and side portions of the main housing 602*a* and can be simply elastically snapped in place. The housing cover 602*b* terminates at its upper, end in a forwardly extending portion 603*b*, which is adapted to engage the nose assembly section 316. At the same time, an arcuate rib 604 is provided at the bottom of the housing cover 602*b* upon which the operator's hand can be supported while gripping during actuation. The housing cover 602*b* is not shown in FIG. 10.

Figure 14:
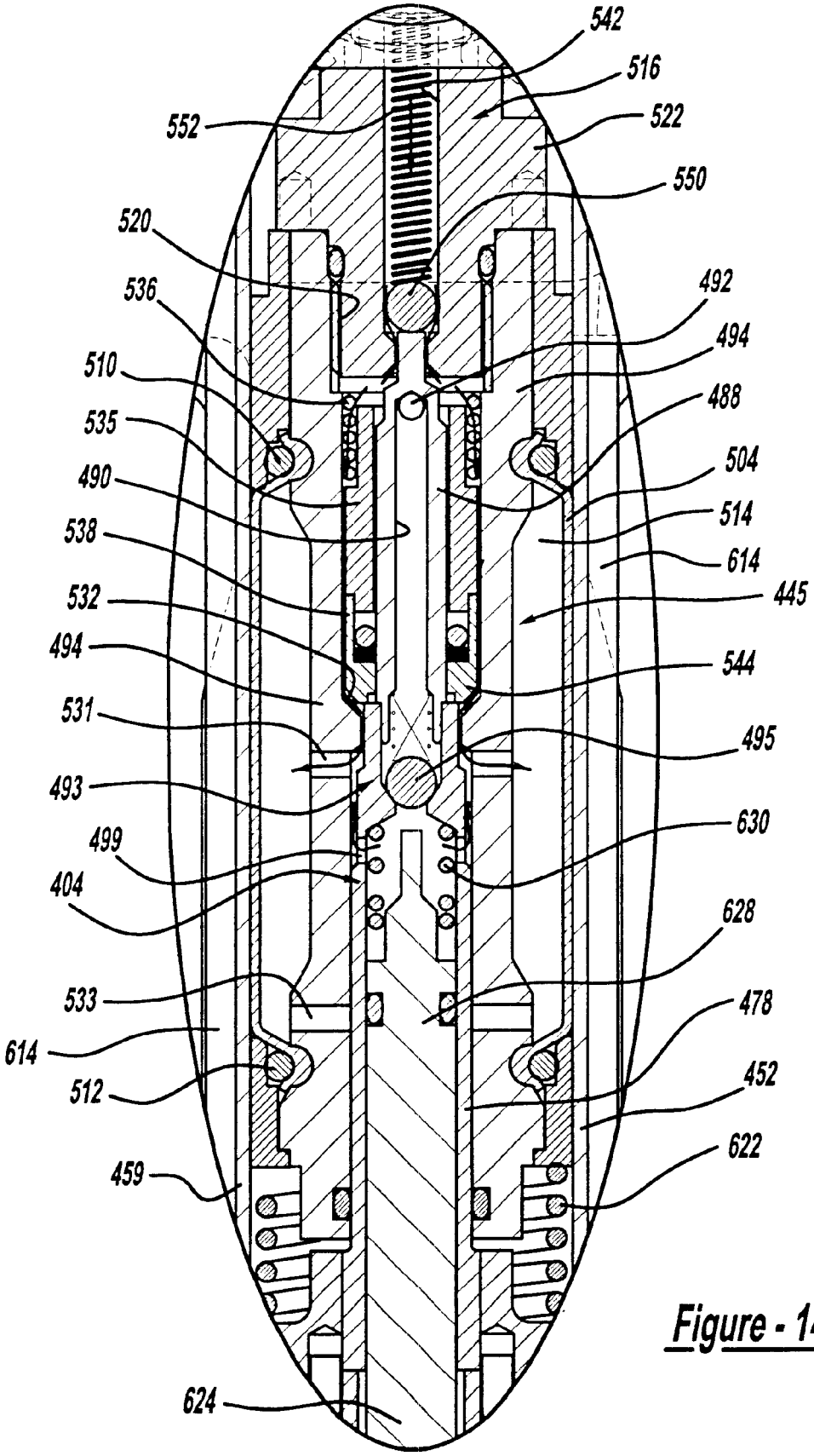
FIG. 14 is a fragmentary view to enlarged scale similar to that of FIG. 13 but taken generally in the area of the Circle 14 in FIG. 10 depicting the valve construction with the tool in the non-energized state for return to idle with the flow of hydraulic fluid in moving for the return to idle shown in lines with arrows indicating the direction of flow of the fluid for return.

As shown in FIG. 10, the manual-hydraulic installation tool 300 is in a state at the end of an energization cycle and in a condition for release of fluid pressure and return of hydraulic fluid to the idle condition. FIGS. 9 and 14, however, depict the manual-hydraulic installation tool 300 in a condition for the initiation of energization to be described.

Now to actuate the tool 300, the operator simply grips the lower portion of the housing assembly 602 with one hand and pivotably reciprocates a handle 606 with the other hand rearwardly and forwardly about axially in line, spaced pivot pins 608. Alternatively, the operator can simply grip both the pivot handle 606 and the housing assembly 602 with one hand and actuate the tool 300 by repetitively squeezing the handle 606 and the housing assembly 602 together and releasing them apart until the fastener is installed.

Looking now to FIGS. 9 and 15–17, the pivot handle 606 has a main handle body 606*a* and a handle cover 606*b*. The handle body 606*a* is of a generally elongated, rectangular contour and has a pair of spaced arm portions 612 at its upper end and is made of a relatively rigid, metallic material such as steel. The arm portions 612 are pivotally supported on the main housing 602*a* at opposite sides of the rearward end of the upper platform support section 603*a* on the pivot pins 608.

The handle cover 606*b* is adapted to generally fit over the rear and side outer surfaces of the handle body 606*a* and in addition has a pair of arm-like portions 605 adapted to generally overengage the arm portions 612. The handle cover 606*b* is also made of an elastomeric material such as Nylon 6 similar to that of the housing cover 602*b* to facilitate ergonomic gripping. The handle cover 606*b* also terminates at its lower end in a vertically arcuate rib 607 to provide support for the operator's hand while gripping. As can be seen in FIG. 9, the handle cover 606*b* while resiliently overengaging the handle body 606*a* is further secured to the handle body 606*a* by a self-tapping screw 609.

The hydraulic pump section 314 includes a hydraulic piston structure 404 which is operatively connected to the pivot handle 606. The hydraulic pump section 314 has a piston housing assembly 445 which is fixed within the housing assembly 602. See FIG. 11 for details of the hydraulic piston structure 404 and FIG. 12 for details of the piston housing assembly 445. The hydraulic piston structure 404 has a housing section 478 which is connected to an end cap 610 which is slidably supported at the bottom end of the main housing 602*a*. A pair of actuating links 614 are connected at their upper ends to the outer ends of the arm portions 612 of the handle body 606*a* with pivot connections 615 located forwardly from the pivot pins 608. The links 614 extend downwardly in slots 616 in the outer surface of the main housing 602*a* and terminate in radially inwardly extending and upwardly curved fingers 618 which are located in slots 620 in the end cap 610. See FIGS. 10 and 15. At the same time the housing cover 602*b* has slots 621 on its internal side surfaces extending in line with slots 616 to receive and cover the portions of the links 614 in the area of the main housing 602*a* to be gripped by the operator. See FIGS. 18 and 19. The hydraulic piston structure 404 is biased downwardly by a coil spring 622. The spring 622 is engaged between the end cap 610 and an elongated hydraulic piston housing 444 of the piston housing assembly 445. In this regard, the bias of spring 622 acts on the links 614 to also bias the handle 606 to its outward, deactuated position as shown in FIG. 9. Thus as the handle 606 is pivoted forwardly by the operator towards the housing assembly 602 against the bias of the spring 622 the links 614 will pull the end cap 610 and hence the housing section 478 and hydraulic piston structure 404 upwardly to compress hydraulic fluid in a manner to be described. The return stroke, of course, is assisted by the bias of the spring 622 to move the handle 606 outwardly in preparation for cyclic repetition of the pressure stroke until installation of the fastener is completed.

The upper ends of the links 614 extend out of the slots 616 and 621 and onto an open, flat area 623 on the main housing 602*a* as it is connected to the pivot connections 615. See FIGS. 10 and 15. Since the links 614 are made of a relatively flexible metallic wire of a generally circular cross-section, this open area 623 facilitates a limited bending or flexing of the upper portion of the links 614 to accommodate the arcuate movement applied at the pivot connections 615 during pivoting of the handle 606.

The housing section 478 of the piston structure 404 has a reduced diameter upper support portion 483 which has a cavity 487 in its outer end in which an elongated piston valve rod 488 is secured. The piston valve rod 488 has a central vertical bore 490 which is communicated with a radial cross bore 492 at its upper end. The rod bore 490 at its lower end is in communication with an axial bore 494 at the end of the cavity 487 which can communicate with the inside of the housing section 478. A relief and refill valve assembly 493 is located in the cavity 487 and includes a ball valve 495 biased by a coil spring 496 into sealing engagement with an upper tapered portion of bore 494. The housing section 478 in turn has a radial cross bore 499 for communicating fluid for pressure relief in a manner to be described.

Figure 12:
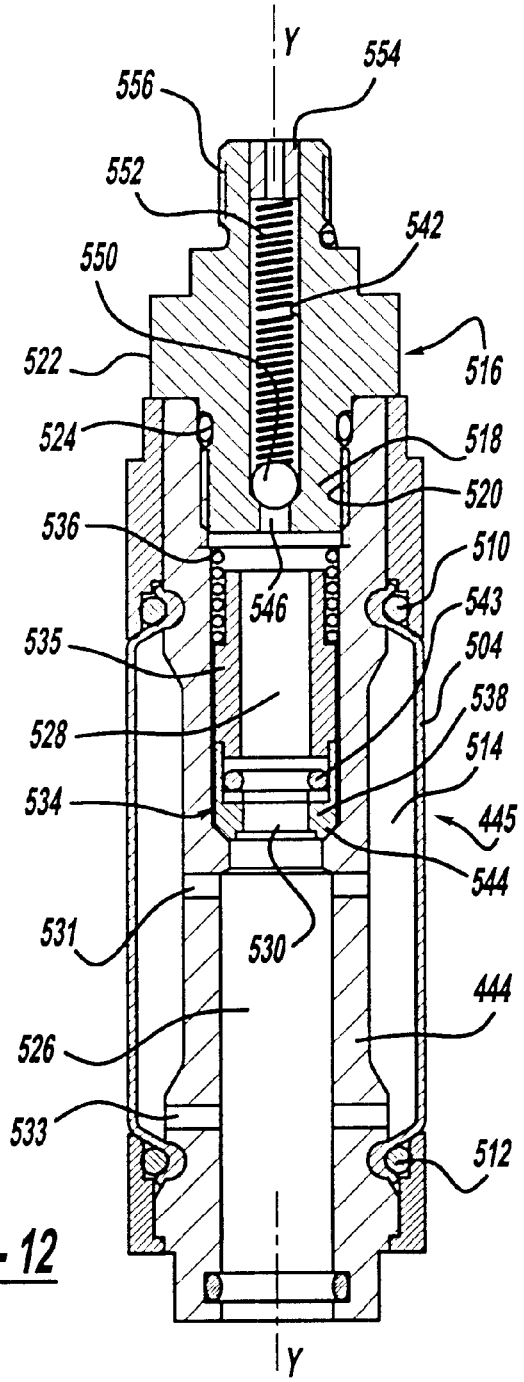
FIG. 12 is an elevational, sectional view to enlarged scale of the hydraulic piston housing assembly of the hydraulic pump section of the tool of FIG. 9.

The piston structure 404 is operatively connected to the piston housing assembly 445, the details of which can be best seen in FIG. 12. Looking now to FIGS. 9, 10 and 12, the piston housing assembly 445 is in a fixed position in the main housing 602*a*, and includes the elongated, cylindrical piston housing 444.

An elongated, elastic, cylindrical bladder 504 extends transversely along the Y axis around a portion of the outer surface of the housing 444 and is held in sealed relationship in transversely spaced grooves in the outer surface by resilient rings 510, 512 at the opposite ends. The bladder 504 defines a fluid reservoir cavity 514 with the confronting surface of the housing 444 with the reservoir cavity 514 having a preselected volume for holding the necessary amount of hydraulic fluid to be pressurized for actuating the pull piston assembly 320 in the nose assembly section 316.

The housing assembly 445 has a connector member 516 which has a bottom portion 518 threadably connected to a threaded bore portion 520 at the upper end of the housing 444 with a flange 522 on the connector member 516 adapted to engage the upper end of the housing 444. The connection between the bottom portion 518 and the bore portion 520 is hydraulically sealed by an annular seal 524.

The housing 444 has a hydraulic reserve cavity 526 at its lower end and a main pressure cavity 528 at its upper end which are in communication by way of a reduced diameter bore 530 having a tapered valve seat at the lower side of the main pressure cavity 528. The reserve cavity 526 is in communication with the reservoir cavity 514 by an upper cross bore or port 531 and a lower cross bore or port 533 extending radially through the housing 444. The upper cross bore 531 is located generally midway along the reservoir cavity 514 and just below a fluid return valve assembly 534 while the lower cross bore 533 is located proximate to the lower end of the reservoir cavity 514.

The return valve assembly 534 is located in the main pressure cavity 528 in clearance relationship with the confronting wall. The valve assembly 534 includes an upper cylindrical casing 535 with a tubular valve head 538 connected to its lower reduced diameter end portion. An annular hydraulic seal 543 seals the bore 530 with the piston valve rod 488 which is reciprocably mounted therein as shown in FIGS. 9, 10, 13 and 14. The return valve head 538 terminates at its lower end in a tapered nose portion 544 adapted to matingly, sealing engage the tapered valve seat of bore 530. The return valve head 538 is biased downwardly by a coil spring 536 to maintain resilient engagement of the nose portion 544 against the tapered valve seat.

A bore 542 extends through the connector member 516 and has a reduced diameter portion 546 at its lower end. A tapered upper valve seat is defined by the connection between the bore 542 and the reduced diameter portion 546. An access ball valve 550 is located in the lower end of bore 542 and is resiliently urged into sealing engagement with the tapered valve seat by a coil spring 552 which has its upper end in engagement with a cylindrical end plug 554 which is press fitted into the upper end of bore 542. As can be seen in FIGS. 9 and 10 the piston housing assembly 445 is adapted to be connected to the hydraulic cylinder housing 324 of the pull piston assembly 320 of the nose assembly section 316 by a threaded connection between a reduced diameter end portion 556 of the connector member 516 and a through bore 558 in the cylinder housing 324 in communication with the cylinder cavity 346. An annular seal hydraulically seals the connection. As will be seen in this way hydraulic fluid under pressure can be communicated to the cylinder cavity 346 from the piston housing assembly 445.

When the operator moves the handle 606 to its forwardmost position adjacent the housing assembly 602, the tool 300 can be brought back into its deactuated, idle condition as shown in FIG. 10. Here the piston valve rod 488 will engage the access ball valve 550 to unseat it whereby fluid in the cavity 346 in the nose assembly section 16 can be returned to the reservoir cavity 514.

As with the pneumatic-hydraulic tool 10, the manual-hydraulic tool 300 can also be used to install fasteners without a frangible pintail. Here, after the fastener has been installed, in order to release the pintail from the jaws 354, the operator simply moves the handle 606 to its forwardmost position as in FIG. 10, whereby the piston valve rod 488 will engage the access ball valve 550 to release fluid from the fluid cavity 346 back to the reservoir cavity 514. In the event that movement of the piston head 332 is blocked the operator simply actuates the pressure release lever 624, as noted above, to release the hydraulic fluid and to relieve the pressure in the main pressure cavity 528 if necessary under conditions as noted. Now the handle 606 can be brought to the forwardmost position shown in FIG. 10 to release the hydraulic fluid and relieve the pressure in the cylinder cavity 346 in the cylinder housing 324 whereby the pull piston 328 will return to its idle position by the return spring 374 and the jaws 354 will be returned to open whereby the pintail can be released.

As noted, FIG. 10 shows the manual-hydraulic tool 300 in its deactuated condition. Here the handle 606 is in engagement with the main housing 602*a* and in this condition, the upper end of the piston valve rod 488 will be in engagement with the access ball valve 550 to maintain it off the valve seat whereby the cylinder cavity 346 in the hydraulic cylinder housing 324 will be open and in fluid communication with the reservoir cavity 514. In this condition the return spring 374 will place the pull piston 328 in its returned or deactuated condition. The flow of hydraulic fluid in return to the reservoir cavity 514 is shown in FIG. 14 by lines with arrows showing the direction of flow.

To actuate the tool 300, the operator simply pivotally reciprocates the handle 606 by pulling it outwardly and pushing it inwardly. It can be seen from FIG. 9 that the piston structure 404 is moved and the piston valve rod 488 is moved out of engagement with the ball valve 550. Now the access ball valve 550 is urged into engagement with the valve seat by the spring 552 to close the cylinder cavity 346. It can be seen from FIG. 9 that in its lowermost position, the piston structure 404 has moved the piston valve rod 488 a preselected distance MM from engagement with the ball valve 550. As will be seen that preselected distance is essentially determined by the maximum stroke of the handle 606 for compression of hydraulic fluid.

Figure 15:
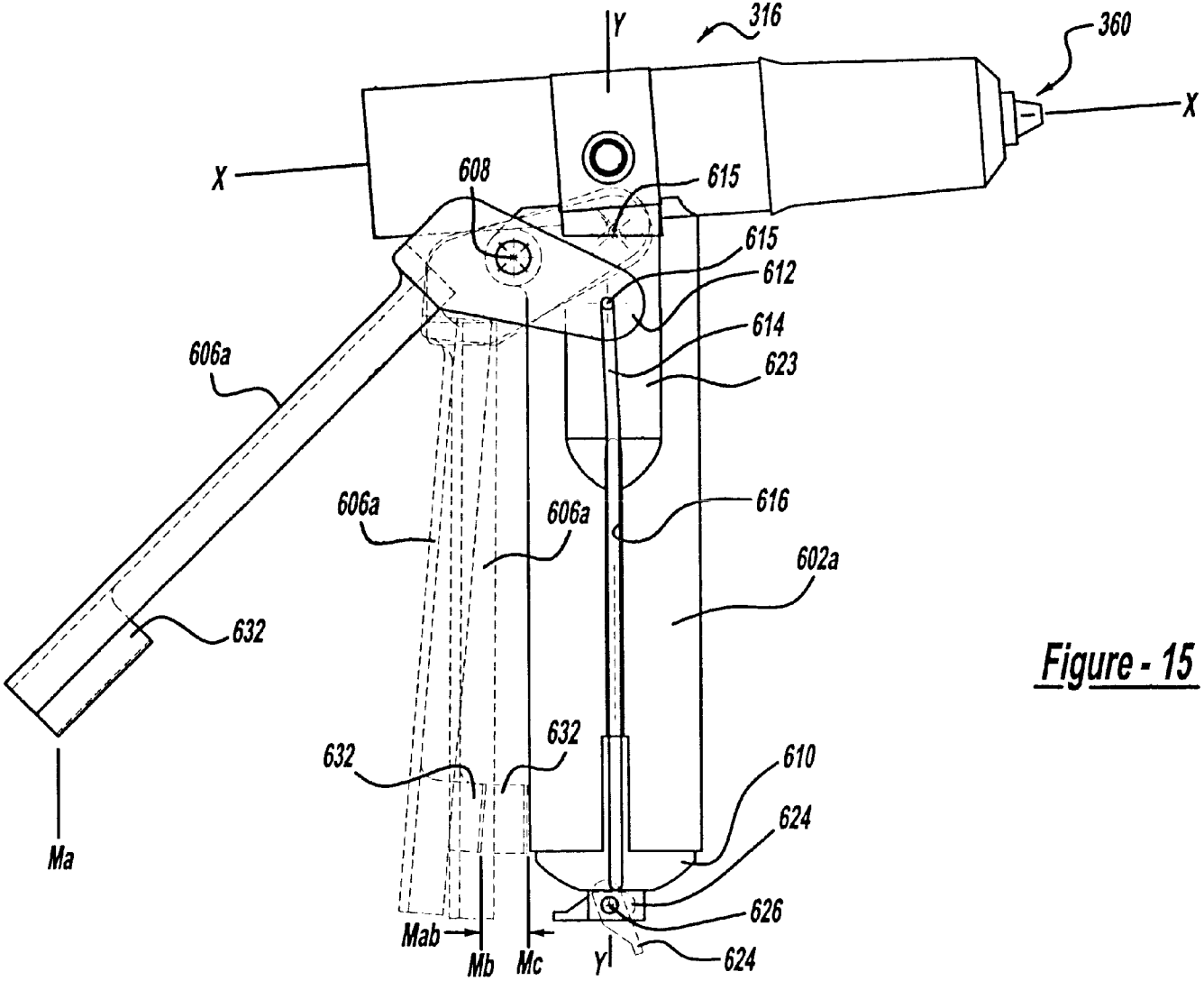
FIG. 15 is a side elevational view of the tool of FIG. 9 with gripping, cover elements removed from the handle and main housing and depicting in dotted lines the various operative conditions of the pivot handle.
Figure 16:
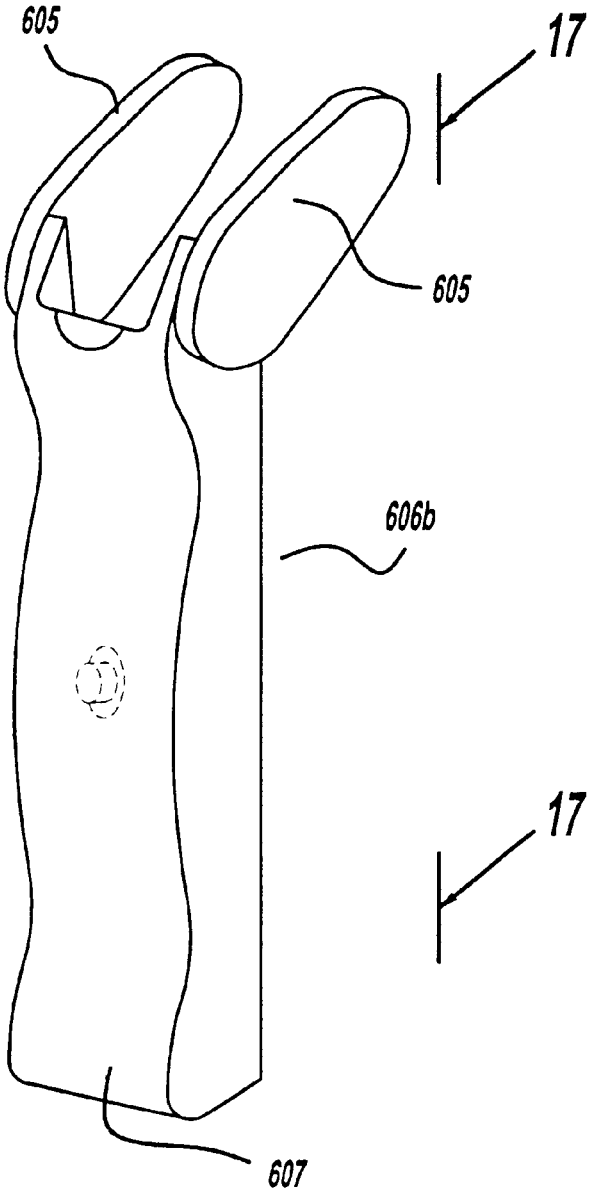
FIG. 16 is a generally pictorial, sectional view of a resilient handle cover for assembly to the pivot handle body generally as shown in FIG. 15.
Figure 17:
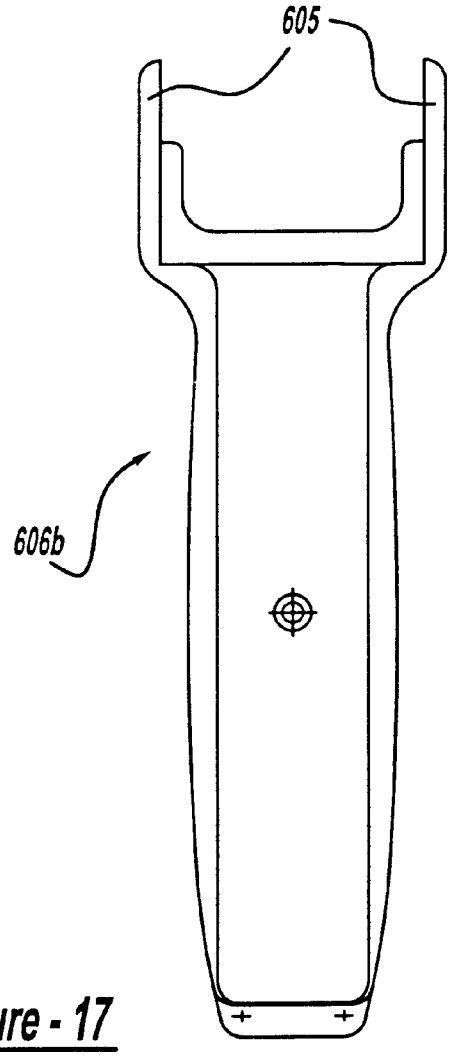
FIG. 17 is an elevational view of the resilient handle cover taken generally in the direction of the arrows 17—17 in FIG. 16.
Figure 18:
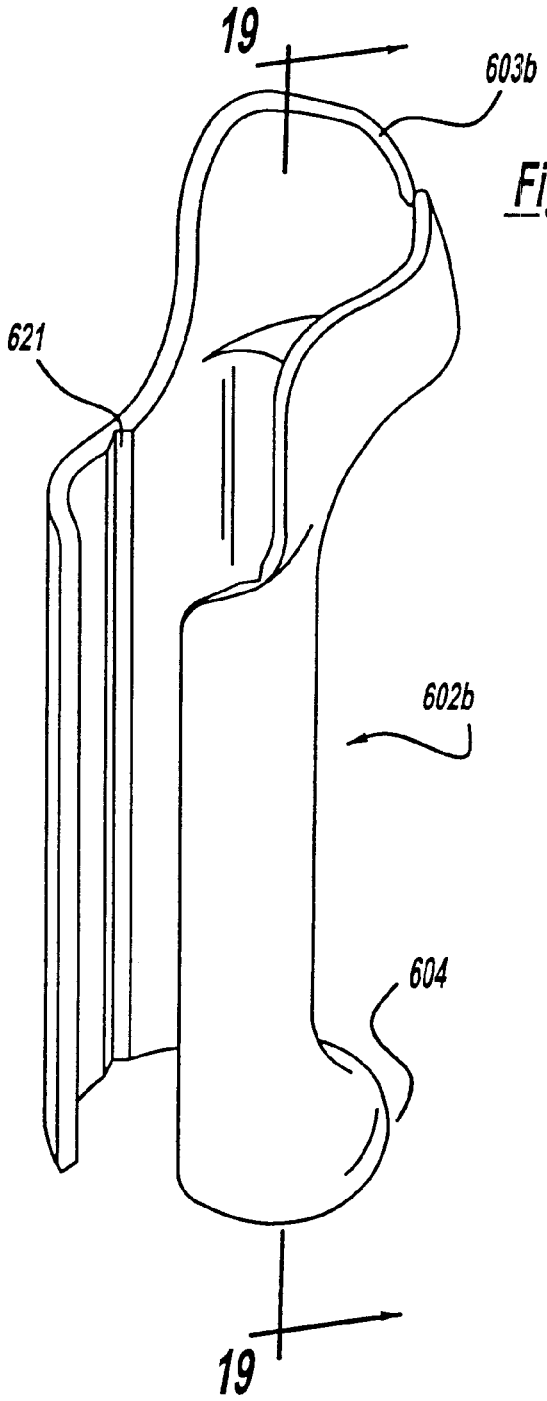
FIG. 18 is a generally pictorial, sectional view of a resilient housing cover for assembly to the front and side sections of the main housing generally as shown in FIG. 15.
Figure 19:
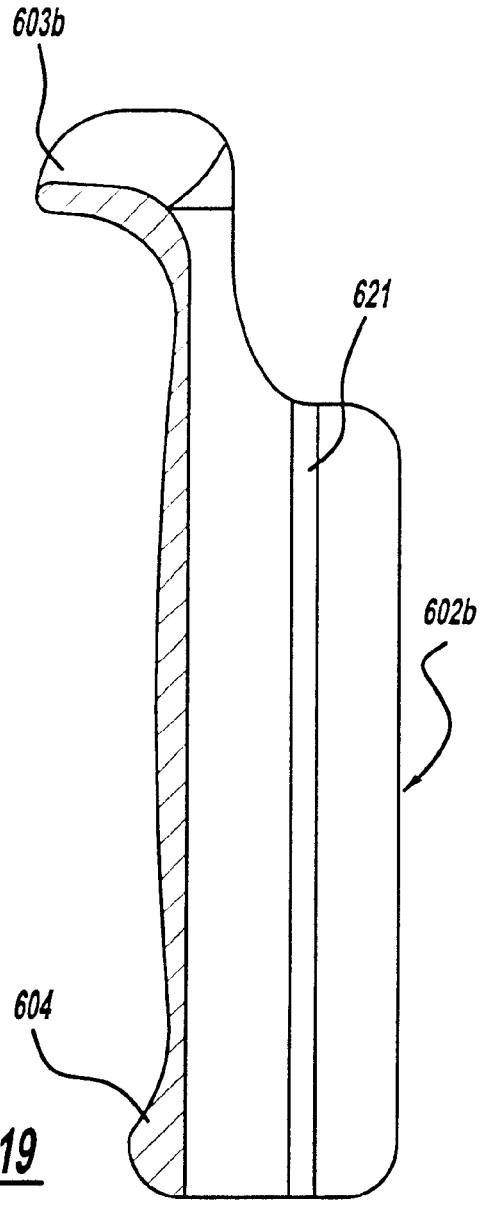
FIG. 19 is a sectional view of the housing cover of FIG. 18 taken generally along the lines 19—19 in FIG. 18.

FIG. 15 shows the maximum stroke of the handle 606 from its rearwardmost position Ma to a position Mb spaced from the housing assembly 602 a distance Mab at which the piston valve rod 488 is proximate to but not in engagement with the access ball valve 550. The rearwardmost position Ma of the handle 606 is also shown in FIG. 9. However, for purposes of clarity, FIG. 15 shows the tool 300 without the housing cover 602*b* and the handle cover 606*b*. Now to deactuate the tool 300, the operator moves the handle 606 to its forwardmost position Mc at which the piston valve rod 488 engages the ball valve 550. See FIGS. 10 and 14. The handle 606 is provided with a resilient stop block 632 located at its lower end and adapted to engage the main housing 602*a* of the housing assembly 602 when in its forwardmost position Mc. The stop block 632 is provided to avoid shock loads and possible damage to the housing assembly 602. Since the stop block 632 will engage the main housing 602*a* the noted positions Ma, Mb and Mc and travel Mab have been shown relative to the stop block 632.

Figure 13:
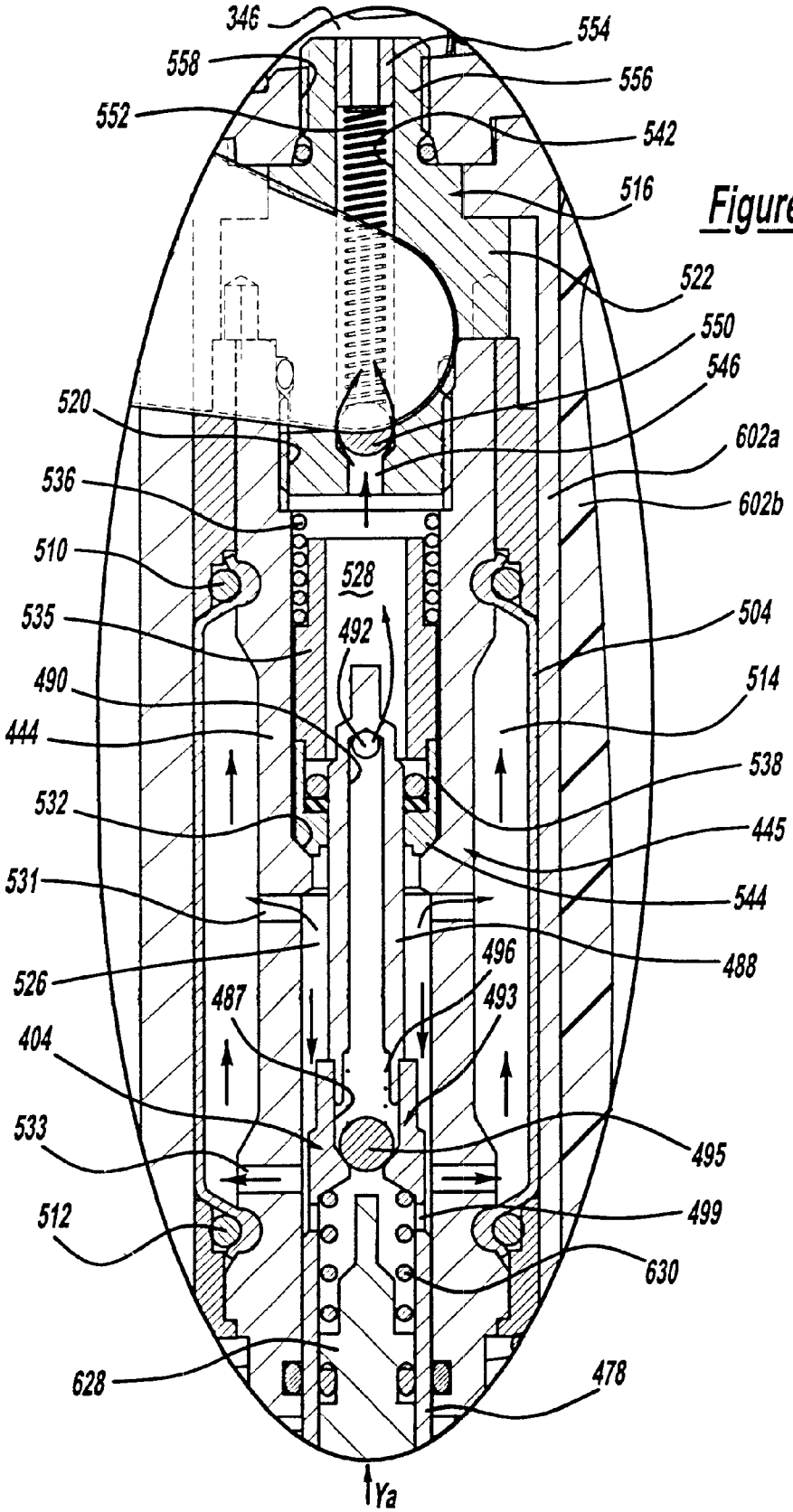
FIG. 13 is a fragmentary view to enlarged scale depicting the hydraulic piston structure and the axially in-line valve construction taken generally in the area of the Circle 13 in FIG. 9 depicting the valve construction with the tool in the actuated state with the flow of hydraulic fluid during actuation shown in lines with arrows indicating the direction of flow of the fluid during actuation with the direction of movement of the hydraulic piston structure shown with a vertical line Ya with an arrow of the direction.

Looking now to FIG. 13, the valve construction is shown in its state for transmitting pressurized hydraulic fluid to the cylinder cavity 346 in the nose assembly section 316. The piston structure 404 is moved upwardly in the direction Ya by movement of the pivot handle 606 forwardly in the pressure stroke. As this occurs the available volume in the main pressure cavity 528 in the housing 444 is reduced resulting in the fluid therein being pressurized. The pressurized fluid in the main pressure cavity 528 flows through the reduced diameter bore portion 546 and moves the access ball valve 550 upwardly against the spring 552 away from the valve seat whereby pressurized fluid will flow through the bore 542 and into the cylinder cavity 346. This then applies pressure to the hydraulic piston head 332 to initiate its rearward movement to apply the pull stroke on the hydraulic piston rod 334. At the same time the upward movement of the housing section 478 of the piston structure 404 reduces the volume in the reserve cavity 526 moving hydraulic fluid through the cross bores 531 and 533 into the reservoir cavity 514 to increase the pressure therein with the elastic bladder 504 resiliently expanding to accept the additional fluid. The direction of flow of hydraulic fluid with the tool 300 actuated in the pressure stroke is shown in FIG. 13 by lines with arrows.

Figure 13A:
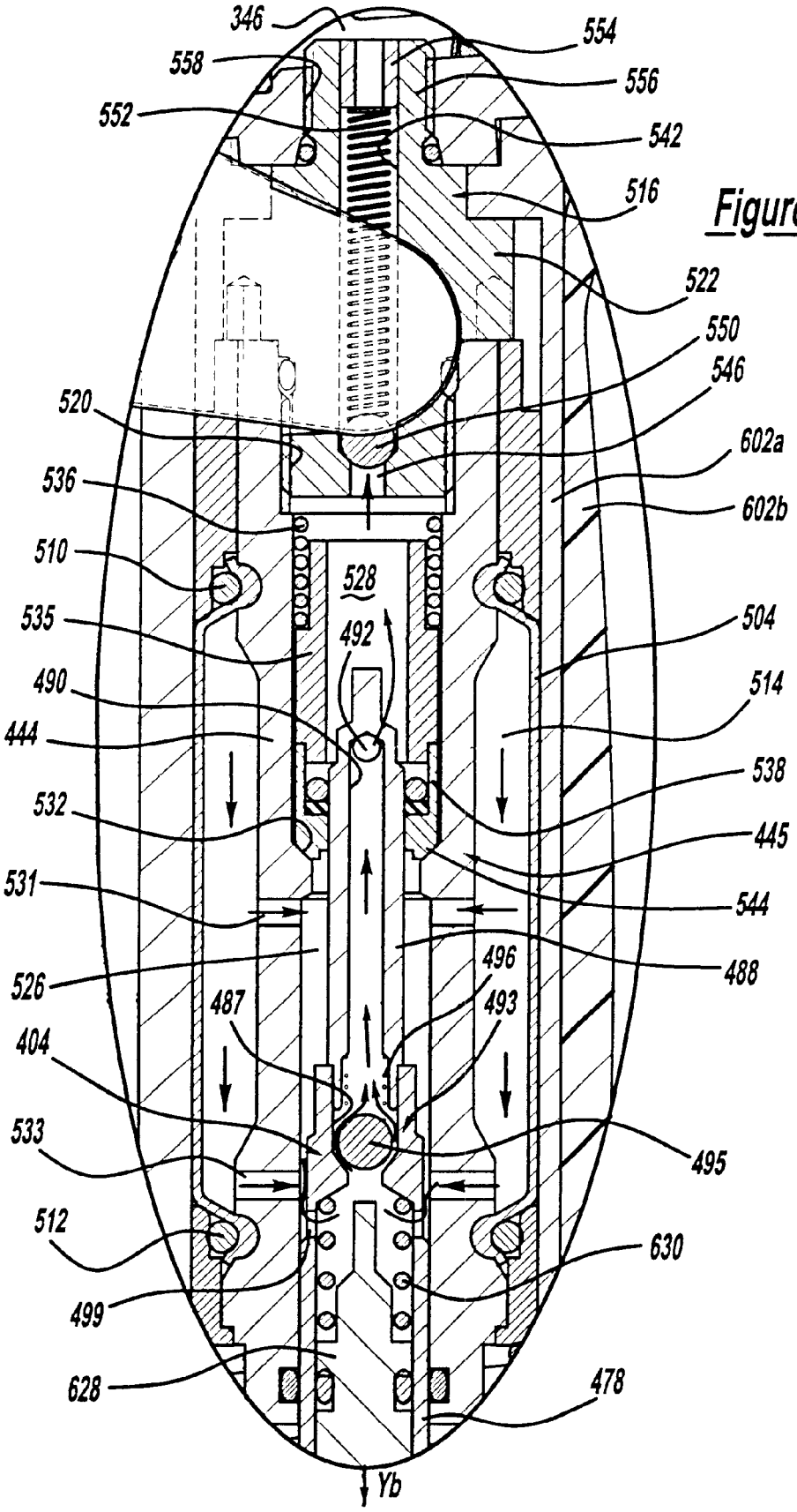
FIG. 13*a* is a fragmentary view similar to FIG. 13 depicting the piston structure and valve construction with the tool in the actuated state during the return, non-pressurized stroke with the flow of hydraulic fluid shown in lines with arrows indicating the direction of fluid flow and with the direction of movement of the hydraulic piston structure shown with a vertical line Yb with an arrow.

The condition of the hydraulic piston structure 404 and the housing assembly 445 during the return stroke of the pneumatic piston structure 404 during its reciprocation is shown in FIG. 13*a*. Now as the hydraulic piston structure 404 is moved downwardly in the direction of the arrow Yb the piston valve rod 488 is moved downwardly from its position proximate to but spaced from the ball valve 550. The downward movement of valve rod 488 will result in the volume of the main pressure cavity 528 increasing whereby the pressure therein will decrease to initiate the creation of a relative vacuum. At the same time the pressure in the reserve cavity 526 and the reservoir cavity 514 while decreasing will be maintained substantially higher and will cause the ball valve 495 to be unseated. Now hydraulic fluid from the reservoir cavity 514 will flow into the reserve cavity 526 and through the clearance between the reduced diameter upper support portion 483 of the piston housing section 478 and the confronting surface of the reserve cavity 526, through the cross bore 499, past the ball valve 495, and into the central rod bore 490 of the piston valve rod 488 and out through the cross bore 492 into the main pressure cavity 528. This then refills the main pressure cavity 528 with hydraulic fluid for pressurization into the cylinder cavity 346 upon the next upward pressure stroke of the hydraulic piston structure 404 during reciprocation. This cycle continues while the installation tool 10 is actuated until the installation of the fastener is completed. Upon deactuation of the installation tool 10, it will be returned to its idle condition as shown in FIGS. 10 and 14 and as previously described. FIG. 13*a* shows the condition of the valve construction with the tool 10 actuated on the return stroke in the direction Yb as described and with the flow of fluid shown by lines with arrows.

It should be noted, however, that since the hydraulic piston structure 404 on the pressure stroke does not reach its full uppermost position as in idle, the piston valve rod 488 will not engage the access ball valve 550 whereby the hydraulic pressure in the cylinder cavity 346 will be maintained during the reciprocating cycle of the handle 606. Thus the hydraulic piston head 332 of pull piston 328 will continue to be moved rearwardly moving the piston rod 334 to close the jaws 354 onto the fastener pin and exert the noted relative pulling force to set the fastener. Once the fastener is set the operator returns the tool 300 to its condition for deactuation by moving the handle 606 to its forwardmost position Mc as shown in FIG. 15.

In this condition, the piston valve rod 488 will be returned to its uppermost position to engage and unseat the access ball valve 550 as shown in FIGS. 10 and 14. At the same time return the valve head 538 will be unseated by engagement with the upper end of the reduced diameter upper portion 483 of the piston housing section 478. Now the hydraulic fluid in the cylinder cavity 346 will be returned to the reservoir cavity 514 by the force of the return spring 374 moving the pull piston 328 to its forward, returned position. The fluid will flow back through the bore 542 through the reduced diameter bore portion 546, into the main pressure cavity 528, past the return valve head 538 which is unseated by the valve rod 488 and around the clearance between the casing 535 and return valve head 538 with the confronting surface of the main pressure cavity 528 and through cross bores or ports 531 and 533 into the reservoir cavity 514.

As can be seen in FIG. 9 when the tool 300 is in the condition at the initiation of the power stroke or near the end of the return stroke, both of the cross bores 531 and 533 are in communication with the reservoir cavity 514. This facilitates the flow of fluid from the reservoir cavity 514 into the reserve cavity 526. However, during the pressure stroke with the relief and refill valve assembly 493 closed, after the piston housing section 478 has moved partially upwardly, it will be in a generally blocking position relative to the lower cross bore 533. This facilitates the movement of the pressurized fluid into the cylinder cavity 346.

In the event the piston head 332 of the pull piston 328 of the nose assembly section 316 is blocked from further movement and the handle 606 is still being actuated to compress the hydraulic fluid in the main pressure cavity 528 the relief and refill valve assembly 493 can be opened in response to manual actuation of a pressure release lever 624 to unseat the ball valve 495 to release hydraulic fluid into the reservoir cavity 514 to thereby relieve the pressure.

Figure 13B:
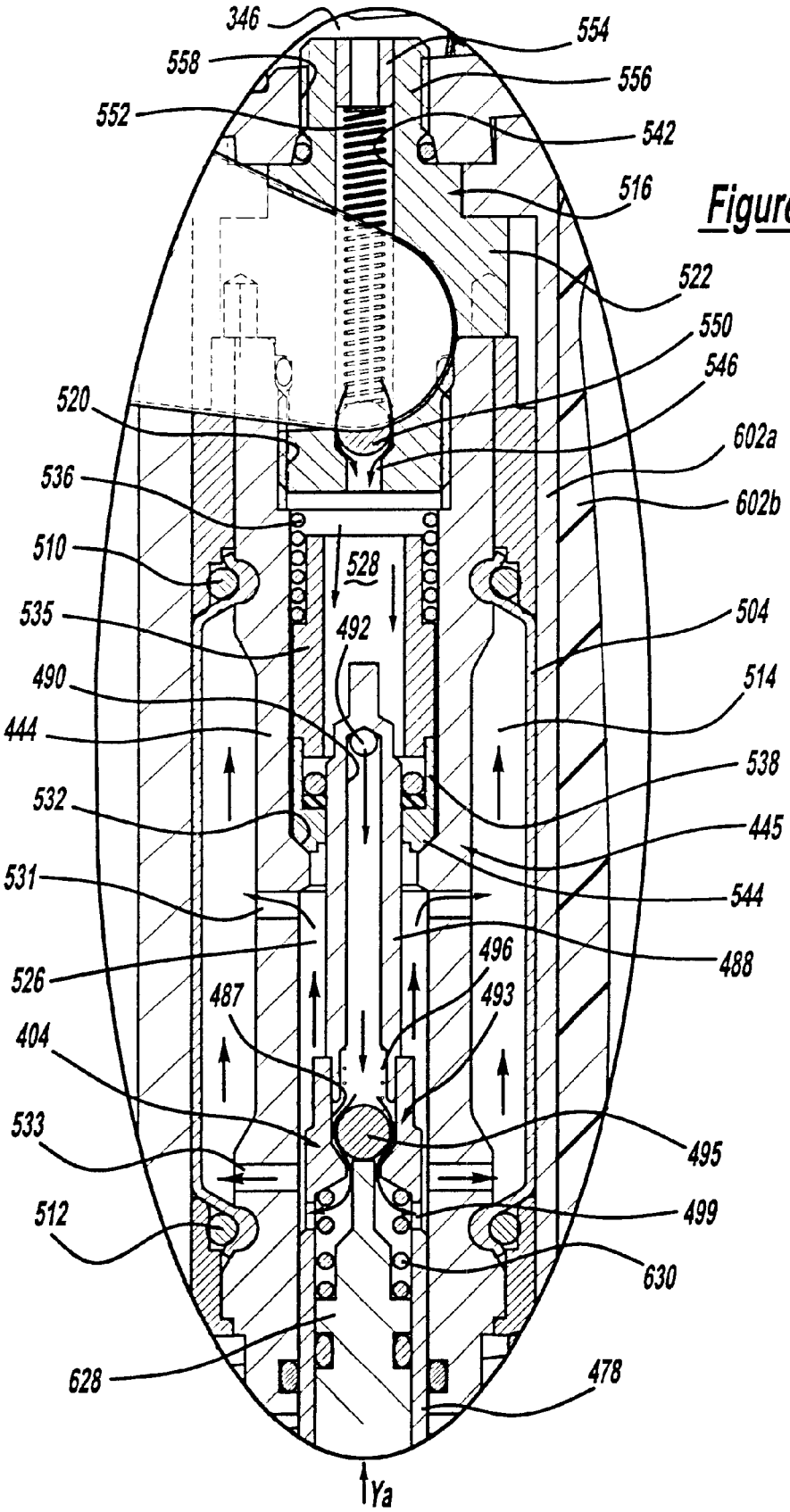
FIG. 13*b* is a fragmentary view similar to FIG. 13 depicting the piston structure and valve construction with the tool in the actuated state with a pressure relief valve actuated to prevent blockage of hydraulic fluid flow and with the direction of movement of the pneumatic-hydraulic piston assembly shown with a vertical line Ya with an arrow.

The release lever 624 is pivotally connected via a pivot pin 626 at the bottom of the end cap 610. A relief valve rod 628 is slidably supported in the lower end of the piston housing section 478 and is biased downwardly by a coil spring 630 to a position spaced from the ball relief and refill valve assembly 495. Now in order to move the handle 606 to its fully returned position adjacent the housing assembly 602 it may be necessary to relieve the pressure in the main pressure cavity 528. This can be done by the operator simply pivoting the release lever 624 downwardly to move its engaged portion upwardly which will move the valve rod 628 upwardly to unseat the ball relief valve 495 whereby fluid pressure will be relieved and the handle 606 can be moved to its forwardmost position adjacent the housing assembly 602 with the piston valve rod 488 moved in the direction Ya to unseat the access ball valve 550. In this condition the fluid in the cavity 346 can be returned to the reservoir cavity 514. The valve rod 628 is shown actuated in FIG. 13*b* by the release lever 624 being pivoted downwardly and with the flow of hydraulic fluid back to the reservoir cavity 514 shown by lines with arrows. FIG. 10 also shows the condition of the tool with the handle 606 in its forwardmost position and with the piston valve rod 488 in its uppermost position whereby access ball valve 550 will be unseated and the pull piston 328 returned to its deactuated state returning fluid from the fluid cavity 346 to the reservoir cavity 514. When this is done, the operator simply pivots the release lever 624 upwardly to move its engaged portion downwardly whereby the valve rod 628 will be biased by coil spring 630 downwardly out of engagement with the ball relief and refill valve 495 and the tool 300 is then in condition as shown in FIG. 10 to install another fastener. As noted, when not in operation, the force of the spring 622 on the links 614 will bias pivot handle 606 to the position shown in FIG. 9 for actuation. With the tool 300 back in the condition of FIG. 9 it is prepared for installation of another fastener.

As can be seen, the valving construction of the hydraulic pump section 314 as described above is essentially in axial alignment. Thus the relief and refill ball valve 495, the return valve assembly 534 and the access ball valve 550 are all in axial alignment. This facilitates manufacture, maintenance and/or repair of the hydraulic pump section 314 and also facilitates the tool 300 being of a compact and relatively lightweight structure.

In this regard, the compact housing assembly 602 facilitates its manufacture from a lightweight metallic material such as cast aluminum.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A manually applied installation tool, for setting fasteners by applying a relative axial pulling force to the fasteners comprising:

first hydraulic means including a first hydraulic piston mounted in a first hydraulic cylinder in a first housing for reciprocation in response to a preselected high hydraulic pressure whereby the relative axial force can be applied to a fastener, second hydraulic means including a second hydraulic piston mounted in a second hydraulic cylinder in a second housing for reciprocation between compressive and non-compressive directions for providing hydraulic fluid at said preselected high hydraulic pressure to said first hydraulic cylinder for application to said first hydraulic piston upon movement in said compressive direction, a fluid reservoir having a supply of hydraulic fluid and connected to said second hydraulic cylinder for providing fluid thereto upon movement of said second hydraulic piston in said non-compressive direction for transmittal under pressure by said second hydraulic piston in said compressive direction to said first hydraulic cylinder for actuating said first hydraulic piston for applying the relative axial pulling force, pneumatic means including a pneumatic cylinder in said second housing and a pneumatic piston, said pneumatic cylinder having a pneumatic cylinder cavity with said pneumatic piston including a piston head supported in said pneumatic cylinder cavity for reciprocation in response to a preselected magnitude of pneumatic pressure in said pneumatic cylinder cavity, said pneumatic piston including a piston rod portion extending from said pneumatic piston head and secured to said second hydraulic piston for providing reciprocating actuation of said second hydraulic piston, connecting means for connecting a source of pneumatic pressure to said pneumatic cylinder cavity, pneumatic valve means including a first valve means located in said pneumatic cylinder and selectively actuable to an open condition for connection to the atmosphere for relieving pneumatic pressure from said pneumatic cylinder cavity and actuable to a closed condition for closing the connection to the atmosphere for blocking the release of pneumatic pressure from said pneumatic cylinder cavity, said first valve means providing primary communication between said pneumatic cylinder cavity and the atmosphere and being in said closed condition when said installation tool is in an idle deactuated condition, resilient means connected to said pneumatic piston for urging said pneumatic piston in a direction for moving said second hydraulic piston in said non-compressive direction for not pressurizing the hydraulic fluid in said second cylinder, said pneumatic pressure in said pneumatic cylinder cavity with said first valve means in said closed condition being sufficient to move said pneumatic piston in said compressive direction against the force of said resilient means, said pneumatic valve means including a second valve means located in said pneumatic cylinder cavity in the flow path of pneumatic air flow from said pneumatic cylinder cavity to said first valve means, said second valve means including a valve actuator secured to said pneumatic piston, said second valve means having a first closed condition with said valve actuator in a first position for blocking flow of pneumatic pressure from said pneumatic cylinder cavity and a second open condition with said valve actuator in a second position for permitting flow of pneumatic pressure from said pneumatic cylinder cavity, said second valve means providing a communication from said pneumatic cylinder cavity to said first valve means through said flow path whereby both said first and second valve means must be in their open conditions for pressure to be relieved to the atmosphere from said pneumatic cylinder cavity, said second valve means normally being in said open condition when said installation tool is in an idle deactuated condition, actuating means manually actuable by the operator for actuating said first valve means to said open condition for relieving pneumatic pressure from said pneumatic cylinder cavity, said resilient means then being actuable to move said pneumatic piston with said second valve means towards said closed condition to block flow of pneumatic pressure from said pneumatic cylinder cavity to the atmosphere such movement moving said second hydraulic piston in said non-compressive direction, when said second valve means is moved into said closed condition the magnitude of pressure in said pneumatic cylinder cavity increases overcoming said resilient means whereby said pneumatic piston and hence said second hydraulic piston are moved in said compressive direction to compress hydraulic fluid in said second hydraulic cylinder for flow into said first hydraulic cylinder for actuating said first hydraulic piston, said pneumatic piston being moved against said resilient means until said second valve means is moved back into said open condition to relieve pneumatic pressure in said pneumatic cylinder cavity whereby said resilient means moves said pneumatic piston in an opposite direction with said second hydraulic piston moving in said non-compressive direction, the movement of said second hydraulic piston in said non-compressive direction causes more hydraulic fluid to flow into said second hydraulic cylinder from said fluid reservoir, the reciprocation of said pneumatic piston and said second hydraulic piston continuing until the fastener is set by the movement and force of said first hydraulic piston and the operator releases said actuating means whereby said first valve means is moved to said closed condition and said installation tool is returned to its idle condition, said installation tool in its idle condition having said first valve means in its closed condition with said pneumatic piston and thus said second hydraulic piston being moved to fixed uppermost positions by the pneumatic pressure in said pneumatic cylinder, access valve means operatively connected to said first and second hydraulic cylinders and being normally biased closed but being actuable to open in response to fluid pressure resulting from movement of said second hydraulic piston in said compressive direction and being actuable by engagement with said second hydraulic piston when in its fixed uppermost position whereby hydraulic fluid in said first hydraulic cylinder will be returned to said fluid reservoir through said second hydraulic cylinder as said first hydraulic piston is moved to its idle condition, said first valve means and said second valve means being operatively connected such that during actuation of said installation tool by the manually actuated means said pneumatic piston and hence second hydraulic piston will be reciprocated between the open and closed conditions of said second valve means while moving a distance less than to their fixed uppermost positions.

2. The installation tool of claim 1 further comprising a separator plate located in said pneumatic cylinder cavity between said pneumatic piston and said first valve means, said second valve means including a valve opening in said separator plate with said valve actuator being operative with said valve opening for placing said valve opening in an open or closed condition in response to reciprocation of said pneumatic piston, whereby said second valve means blocks the flow of pneumatic pressure from said pneumatic cylinder cavity when in the closed condition and permits the flow of pneumatic pressure from said pneumatic cavity when in the open condition.

3. The installation tool of claim 1 further comprising a separator plate located in said pneumatic cylinder cavity between said pneumatic piston and said first valve means, said second valve means including a valve opening in said separator plate With said valve actuator being operative with said valve opening for placing said valve opening in an open or closed condition in response to reciprocation of said pneumatic piston, whereby said second valve means blocks the flow of pneumatic pressure from said pneumatic cylinder cavity when in the closed condition and permits the flow of pneumatic pressure from said pneumatic cavity when in the open condition, said second valve means including lost motion means connecting said valve actuator to said pneumatic piston whereby said valve actuator engages said valve opening to close said second valve means before said pneumatic piston reaches the end of its down stroke and remains engaged with said valve opening until said pneumatic piston has reached a preselected position during its upward stroke.

4. The installation tool of claim 1 further comprising a high pressure relief valve connected to said second hydraulic cylinder and being selectively operable in response to a preselected magnitude of high fluid pressure in said second hydraulic cylinder to open and to relieve the fluid pressure with flow of hydraulic fluid back to said fluid reservoir.

5. The installation tool of claim 1 further comprising a high pressure relief valve connected to said second hydraulic cylinder and being selectively operable in response to a preselected magnitude of high fluid pressure in said second hydraulic cylinder to open and to relieve the fluid pressure with flow of hydraulic fluid back to said fluid reservoir, refill valve means operable for permitting flow of hydraulic fluid from said fluid reservoir into said second hydraulic cylinder upon movement of said second hydraulic piston in said non-compressive direction, said pressure relief valve means, said refill valve means and said access valve means being substantially axially in line with said second hydraulic piston along the axis of reciprocation of said second hydraulic piston.

6. The installation tool of claim 1 with said connecting means including an air flow opening to said pneumatic cylinder cavity for flow of air from said source of pneumatic pressure to said pneumatic cylinder cavity, said air flow opening providing a preselected restriction to flow of air to said pneumatic cylinder cavity whereby the rate of pressure rise in said pneumatic cylinder is regulated to control the speed of movement of said pneumatic piston in the compressive direction to a rate whereby shock loads are substantially avoided and to avoid excessive resistance to the movement of said pneumatic piston in the non-compressive direction as urged by said resilient means.

7. The installation tool of claim 1 further comprising a separator plate located in said pneumatic cylinder cavity between said pneumatic piston and said first valve means, said second valve means including a valve opening in said separator plate with said valve actuator being operative with said valve opening for placing said valve opening in an open or closed condition in response to reciprocation of said pneumatic piston, whereby said second valve means blocks the flow of pneumatic pressure from said pneumatic cylinder cavity when in the closed condition and permits the flow of pneumatic pressure from said pneumatic cavity when in the open condition, said second valve means including lost motion means connecting said valve actuator to said pneumatic piston whereby said valve actuator engages said valve opening to close said second valve means before said pneumatic piston reaches the end of its down stroke and remains engaged with said valve opening until said pneumatic piston has reached a preselected position during its upward stroke, a high pressure relief valve connected to said second hydraulic cylinder and being selectively operable in response to a preselected magnitude of high fluid pressure in said second hydraulic cylinder to open and to relieve the fluid pressure with flow of hydraulic fluid back to said fluid reservoir, refill valve means operable for permitting flow of hydraulic fluid from said fluid reservoir into said second hydraulic cylinder upon movement of said second hydraulic piston in said non-compressive direction, said pressure relief valve means, said refill valve means, said access valve means, said pneumatic valve actuator and said valve opening being substantially axially in line with said second hydraulic piston along the axis of reciprocation of said second hydraulic piston.

8. A manually applied installation tool, for setting fasteners by applying a relative axial pulling force to the fasteners comprising:

first hydraulic means including a first hydraulic piston mounted in a first hydraulic cylinder in a first housing for reciprocation in response to a preselected high hydraulic pressure whereby the relative axial force can be applied to a fastener, said first housing and first hydraulic cylinder having a first axis with said first hydraulic piston reciprocating along said first axis, second hydraulic means including a second hydraulic piston mounted in a second hydraulic cylinder in a second housing for reciprocation between compressive and non-compressive directions for providing hydraulic fluid at said preselected high hydraulic pressure to said first hydraulic cylinder for application to said first hydraulic piston upon movement in said compressive direction, said second housing and said second hydraulic cylinder having a second axis generally transverse to said first axis with said second hydraulic piston reciprocating along said second axis, said compressive direction being along said second axis towards said first hydraulic cylinder and said non-compressive direction being along said second axis away from said first hydraulic cylinder, a fluid reservoir having a supply of hydraulic fluid and connected to said second hydraulic cylinder for providing fluid thereto upon movement of said second hydraulic piston in said non-compressive direction for transmittal under pressure by said second hydraulic piston in said compressive direction to said first hydraulic cylinder for actuating said first hydraulic piston for applying the relative axial pulling force, pneumatic means including a pneumatic cylinder in said second housing and a pneumatic piston, said pneumatic cylinder and said pneumatic piston extends along said second axis, said pneumatic cylinder having a pneumatic cylinder cavity with said pneumatic piston including a piston head supported in said pneumatic cylinder cavity for reciprocation along said second axis in response to a preselected magnitude of pneumatic pressure in said pneumatic cylinder cavity, said pneumatic piston including a piston rod portion extending from said pneumatic piston head and secured to said second hydraulic piston for providing reciprocating actuation of said second hydraulic piston along said second axis, connecting means for connecting a source of pneumatic pressure to said pneumatic cylinder cavity, pneumatic valve means including a first valve means located in said pneumatic cylinder and selectively actuable to an open condition for connection to the atmosphere for relieving pneumatic pressure from said pneumatic cylinder cavity and actuable to a closed condition for closing the connection to the atmosphere for blocking the release of pneumatic pressure from said pneumatic cylinder cavity, said first valve means providing primary communication between said pneumatic cylinder cavity and the atmosphere and being in said closed condition when said installation tool is in an idle deactuated condition, resilient means connected to said pneumatic piston for urging said pneumatic piston in a direction along said second axis for moving said second hydraulic piston in said non-compressive direction for not pressurizing the hydraulic fluid in said second cylinder, said pneumatic pressure in said pneumatic cylinder cavity with said first valve means in said closed condition being sufficient to move said pneumatic piston in said compressive direction against the force of said resilient means, said pneumatic valve means including a second valve means located in said pneumatic cylinder cavity in the flow path of pneumatic air flow from said pneumatic cylinder cavity to said first valve means, said second valve means including a valve actuator secured to said pneumatic piston, said second valve means having a first closed condition with said valve actuator in a first position for blocking flow of pneumatic pressure from said pneumatic cylinder cavity and a second open condition with said valve actuator in a second position for permitting flow of pneumatic pressure from said pneumatic cylinder cavity, said second valve means providing a communication from said pneumatic cylinder cavity to said first valve means through said flow path whereby both said first and second valve means must be in their open conditions for pressure to be relieved to the atmosphere from said pneumatic cylinder cavity, said second valve means normally being in said open condition when said installation tool is in an idle deactuated condition, actuating means manually actuable by the operator for actuating said first valve means to said open condition for relieving pneumatic pressure from said pneumatic cylinder cavity, said resilient means then being actuable to move said pneumatic piston with said second valve means towards said closed condition to block flow of pneumatic pressure from said pneumatic cylinder cavity to the atmosphere such movement moving said second hydraulic piston in said non-compressive direction, when said second valve means is moved into said closed condition the magnitude of pressure in said pneumatic cylinder cavity increases overcoming said resilient means whereby said pneumatic piston and hence said second hydraulic piston are moved in said compressive direction to compress hydraulic fluid in said second hydraulic cylinder for flow into said first hydraulic cylinder for actuating said first hydraulic piston, said pneumatic piston being moved against said resilient means until said second valve means is moved back into said open condition to relieve pneumatic pressure in said pneumatic cylinder cavity whereby said resilient means moves said pneumatic piston in an opposite direction with said second hydraulic piston moving in said non-compressive direction, the movement of said second hydraulic piston in said non-compressive direction causes more hydraulic fluid to flow into said second hydraulic cylinder from said fluid reservoir, the reciprocation of said pneumatic piston and said second hydraulic piston continuing until the fastener is set by the movement and force of said first hydraulic piston and the operator releases said actuating means whereby said first valve means is moved to said closed condition and said installation tool is returned to its idle condition, said installation tool in its idle condition having said first valve means in its closed condition with said pneumatic piston and thus said second hydraulic piston being moved to fixed uppermost positions by the pneumatic pressure in said pneumatic cylinder, access valve means operatively connected to said first and second hydraulic cylinders and being normally biased closed but being actuable to open in response to fluid pressure resulting from movement of said second hydraulic piston in said compressive direction and being actuable by engagement with said second hydraulic piston when in its fixed uppermost position whereby hydraulic fluid in said first hydraulic cylinder will be returned to said fluid reservoir through said second hydraulic cylinder as said first hydraulic piston is moved to its idle condition, said first valve means and said second valve means being operatively connected such that during actuation of said installation tool by the manually actuated means said pneumatic piston and hence second hydraulic piston will be reciprocated between their open and closed conditions while moving a distance less than to their fixed uppermost positions, a separator plate located in said pneumatic cylinder cavity between said pneumatic piston and said first valve means, said second valve means including a valve opening in said separator plate with said valve actuator being operative with said valve opening for placing said valve opening in an open or closed condition in response to reciprocation of said pneumatic piston, whereby said second valve means blocks the flow of pneumatic pressure from said pneumatic cylinder cavity when in the closed condition and permits the flow of pneumatic pressure from said pneumatic cavity when in the open condition, a high pressure relief valve connected to said second hydraulic cylinder and being selectively operable in response to a preselected magnitude of high fluid pressure in said second hydraulic cylinder to open and to relieve the fluid pressure with flow of hydraulic fluid back to said fluid reservoir.

9. The installation tool of claim 8 including refill valve means operable for permitting flow of hydraulic fluid from said fluid reservoir into said second hydraulic cylinder upon movement of said second hydraulic piston in said non-compressive direction, said pressure relief valve means, said refill valve means and said access valve means being substantially axially in line with said second hydraulic piston along the axis of reciprocation of said second hydraulic piston.

10. The installation tool of claim 8 including refill valve means operable for permitting flow of hydraulic fluid from said fluid reservoir into said second hydraulic cylinder upon movement of said second hydraulic piston in said non-compressive direction, said pressure relief valve means, said refill valve means, said access valve means, said pneumatic valve actuator and said valve opening being substantially axially in line with said second hydraulic piston along the axis of reciprocation of said second hydraulic piston.

11. The installation tool of claim 8 with said connecting means including an air flow opening to said pneumatic cylinder cavity for flow of air from said source of pneumatic pressure to said pneumatic cylinder cavity, said air flow opening providing a preselected restriction to flow of air to said pneumatic cylinder cavity whereby the rate of pressure rise in said pneumatic cylinder is regulated to control the speed of movement of said pneumatic piston in the compressive direction to a rate whereby shock loads are substantially avoided and to avoid excessive resistance to the movement of said pneumatic piston in the non-compressive direction as urged by said resilient means.

12. A manually applied installation tool, for setting fasteners by applying a relative axial pulling force to the fasteners comprising:

first hydraulic means including a first hydraulic piston mounted in a first hydraulic cylinder in a first housing for reciprocation in response to a preselected high pressure whereby the relative axial force can be applied to a fastener, second hydraulic means including a second hydraulic piston mounted in a second hydraulic cylinder in a second housing for reciprocation between compressive and non-compressive directions for providing hydraulic fluid at said preselected high hydraulic pressure to said first cylinder for application to said first hydraulic piston upon movement in said compressive direction, a fluid reservoir having a supply of hydraulic fluid and connected to said second hydraulic cylinder for providing fluid thereto upon movement of said second hydraulic piston in said non-compressive direction for transmittal under pressure by said second hydraulic piston in said compressive direction to said first hydraulic cylinder for actuating said first hydraulic piston for applying the relative axial pulling force, resilient means connected to said second hydraulic piston for urging said second hydraulic piston in said compressive direction, mechanical means connected to said second hydraulic piston and being manually actuable for reciprocating said second hydraulic piston in said second hydraulic cylinder for movement in said compressive direction for pressurizing fluid in said second hydraulic cylinder for flow into said first hydraulic cylinder under pressure and for movement in an opposite non-compressive direction to receive more fluid from said fluid reservoir into said second fluid cylinder to replenish the amount of fluid moved into said first hydraulic cylinder in preparation for movement again in said compressive direction, said mechanical means including a handle structure pivotally connected to said second housing for pivotal movement manually by the operator and connected to said second hydraulic piston by a link structure whereby pivotal movement of said handle structure actuates said link structure to reciprocate said second hydraulic piston linearly within said second hydraulic cylinder between said compressive and non-compressive directions, said handle structure and hence said link structure having first and second end positions and in operation being reciprocated in said compressive and non-compressive directions between said end positions for a distance short of said second position, the reciprocation by the operator of said link structure by said handle structure and reciprocation of said second hydraulic piston continuing until the fastener is set, access valve means operatively connected to said first and second hydraulic cylinders and being normally biased closed but being actuable to open in response to fluid pressure resulting from movement of said second hydraulic piston in said compressive direction and being actuable by said second hydraulic piston when moved to an end position by actuation of said handle structure and said link structure by the operator to their second positions whereby hydraulic fluid in said first hydraulic cylinder will be returned to said fluid reservoir through said second hydraulic cylinder whereby said installation tool is returned to its idle condition.

13. The installation tool of claim 12 including a pressure relief mechanism having a pressure relief valve being selectively manually actuable by the operator for relieving fluid pressure in said second hydraulic cylinder with flow of hydraulic fluid back to said third reservoir whereby said installation tool can be returned to its idle condition.

14. The installation tool of claim 12 including a pressure relief mechanism having a pressure relief valve being selectively manually actuable by the operator for relieving fluid pressure in said second hydraulic cylinder with flow of hydraulic fluid back to said third reservoir whereby said installation tool can be returned to its idle condition, refill valve means operable in response to a reduction in pressure for permitting flow of hydraulic fluid from said fluid reservoir into said second hydraulic cylinder upon movement of said second hydraulic piston in said non-compressive direction, said pressure relief valve, said refill valve means and said access valve means being substantially axially in line with said second hydraulic piston along the axis of reciprocation of said second hydraulic piston.

15. The installation tool of claim 12 including a pressure relief mechanism having a pressure relief valve being selectively manually actuable by the operator for relieving fluid pressure in said second hydraulic cylinder with flow of hydraulic fluid back to said third reservoir whereby said installation tool can be returned to its idle condition, refill valve means operable in response to a reduction in pressure for permitting flow of hydraulic fluid from said fluid reservoir into said second hydraulic cylinder upon movement of said second hydraulic piston in said non-compressive direction, said refill valve means including said pressure relief valve.

16. The installation tool of claim 12 including a pressure relief mechanism having a pressure relief valve being selectively manually actuable by the operator for relieving fluid pressure in said second hydraulic cylinder with flow of hydraulic fluid back to said third reservoir whereby said installation tool can be returned to its idle condition, refill valve means operable in response to a reduction in pressure for permitting flow of hydraulic fluid from said fluid reservoir into said second hydraulic cylinder upon movement of said second hydraulic piston in said non-compressive direction, said relief valve of said refill valve means including said relief valve operable in response to the reduction in pressure, said relief valve of said pressure relief valve means and of said refill valve means being substantially axially in line with said access valve means and with said second hydraulic piston along the axis of reciprocation of said second hydraulic piston.

17. A manually applied installation tool, for setting fasteners by applying a relative axial pulling force to the fasteners comprising:

first hydraulic means including a first hydraulic piston mounted in a first hydraulic cylinder in a first housing for reciprocation in response to a preselected high hydraulic pressure whereby the relative axial force can be applied to a fastener, second hydraulic means including a second hydraulic piston mounted in a second hydraulic cylinder in a second housing for reciprocation between compressive and non-compressive directions for providing hydraulic fluid at said preselected high hydraulic pressure to said first hydraulic cylinder for application to said first hydraulic piston upon movement in said compressive direction, a fluid reservoir in said second housing and having a supply of hydraulic fluid and connected to said second hydraulic cylinder for providing fluid thereto upon movement of said second hydraulic piston in said non-compressive direction for transmittal under pressure by said second hydraulic piston in said compressive direction to said first hydraulic cylinder for actuating said first hydraulic piston for applying the relative axial pulling force, said fluid reservoir comprising a resilient bladder circumferentially surrounding at least a portion of said second hydraulic cylinder for defining a reservoir cavity therewith and ports communicating said reservoir cavity with said second hydraulic cylinder, reciprocating force means connected to said second hydraulic piston and selectively actuable by the operator for providing reciprocating actuation of said second hydraulic piston between said compressive and non-compressive directions, said second hydraulic piston when moved during reciprocation in said compressive direction compresses hydraulic fluid in said second hydraulic cylinder for flow into said first hydraulic cylinder for actuating said first hydraulic piston during reciprocation of said second hydraulic piston and movement in said non-compressive direction more hydraulic fluid flows into said second hydraulic cylinder from said reservoir cavity through said ports, the reciprocation of said second hydraulic piston being continued until the fastener is set by the movement and force of said first hydraulic piston after which the operator ceases pressurized actuation, with said installation tool in its idle condition said second hydraulic piston can be moved to an uppermost position, access valve means operatively connected to said first and second hydraulic cylinders and being normally biased closed but being actuable to open in response to fluid pressure resulting from movement of said second hydraulic piston in said compressive direction and being actuable by engagement with said second hydraulic piston when in its fixed uppermost position whereby hydraulic fluid in said first hydraulic cylinder will be returned to said reservoir cavity through said ports in said second hydraulic cylinder whereby said installation tool is returned to its idle condition.

18. The installation tool of claim 17 including pressure relief means being operable for relieving fluid pressure in said second hydraulic cylinder with flow of hydraulic fluid back to said fluid reservoir.

19. The installation tool of claim 17 including pressure relief valve means operable for relieving fluid pressure in said second hydraulic cylinder, refill valve means operable for permitting flow of hydraulic fluid from said fluid reservoir into said second hydraulic cylinder upon movement of said second hydraulic piston in said non-compressive direction, said pressure relief valve means, said refill valve means and said access valve means being substantially axially in line with said second hydraulic piston along the axis of reciprocation of said second hydraulic piston.

20. A manually applied installation tool, for setting fasteners by applying a relative axial pulling force to the fasteners comprising:

first hydraulic means including a first hydraulic piston mounted in a first hydraulic cylinder in a first housing for reciprocation in response to a preselected high hydraulic pressure whereby the relative axial force can be applied to a fastener, second hydraulic means including a second hydraulic piston mounted in a second hydraulic cylinder in a second housing for reciprocation between compressive and non-compressive directions for providing hydraulic fluid at said preselected high hydraulic pressure to said first hydraulic cylinder for application to said first hydraulic piston upon movement in said compressive direction, a fluid reservoir having a supply of hydraulic fluid and connected to said second hydraulic cylinder for providing fluid thereto upon movement of said second hydraulic piston in said non-compressive direction for transmittal under pressure by said second hydraulic piston in said compressive direction to said first hydraulic cylinder for actuating said first hydraulic piston for applying the relative axial pulling force, pneumatic means including a pneumatic cylinder in said second housing and a pneumatic piston, said pneumatic cylinder having a pneumatic cylinder cavity with said pneumatic piston including a piston head supported in said pneumatic cylinder cavity for reciprocation in response to a preselected magnitude of pneumatic pressure in said pneumatic cylinder cavity, said pneumatic piston including a piston rod portion extending from said pneumatic piston head and secured to said second hydraulic piston for providing reciprocating actuation of said second hydraulic piston, connecting means for connecting a source of pneumatic pressure to said pneumatic cylinder cavity, pneumatic valve means including a first valve means located in said pneumatic cylinder and selectively actuable to an open condition for connection to the atmosphere for relieving pneumatic pressure from said pneumatic cylinder cavity and actuable to a closed condition for closing the connection to the atmosphere for blocking the release of pneumatic pressure from said pneumatic cylinder cavity, said first valve means providing primary communication between said pneumatic cylinder cavity and the atmosphere and being in said closed condition when said installation tool is in an idle deactuated condition, resilient means connected to said pneumatic piston for urging said pneumatic piston in a direction for moving said second hydraulic piston in said non-compressive direction for not pressurizing the hydraulic fluid in said second cylinder, said pneumatic pressure in said pneumatic cylinder cavity with said first valve means in said closed condition being sufficient to move said pneumatic piston in said compressive direction against the force of said resilient means, said pneumatic valve means including a second valve means located in said pneumatic cylinder cavity in the flow path of pneumatic air flow from said pneumatic cylinder cavity to said first valve means, said second valve means including a valve actuator secured to said pneumatic piston, said second valve means having a first closed condition with said valve actuator in a first position for blocking flow of pneumatic pressure from said pneumatic cylinder cavity and a second open condition with said valve actuator in a second position for permitting flow of pneumatic pressure from said pneumatic cylinder cavity, said second valve means providing a communication from said pneumatic cylinder cavity to said first valve means through said flow path whereby both said first and second valve means must be in their open conditions for pressure to be relieved to the atmosphere from said pneumatic cylinder cavity, said second valve means normally being in said open condition when said installation tool is in an idle deactuated condition, actuating means manually actuable by the operator for actuating said first valve means to said open condition for relieving pneumatic pressure from said pneumatic cylinder cavity, said resilient means then being actuable to move said pneumatic piston with said second valve means towards said closed condition to block flow of pneumatic pressure from said pneumatic cylinder cavity to the atmosphere such movement moving said second hydraulic piston in said non-compressive direction, when said second valve means is moved into said closed condition the magnitude of pressure in said pneumatic cylinder cavity increases overcoming said resilient means whereby said pneumatic piston and hence said second hydraulic piston are moved in said compressive direction to compress hydraulic fluid in said second hydraulic cylinder for flow into said first hydraulic cylinder for actuating said first hydraulic piston, said pneumatic piston being moved against said resilient means until said second valve means is moved back into said open condition to relieve pneumatic pressure in said pneumatic cylinder cavity whereby said resilient means moves said pneumatic piston in an opposite direction with said second hydraulic piston moving in said non-compressive direction, the movement of said second hydraulic piston in said non-compressive direction causes more hydraulic fluid to flow into said second hydraulic cylinder from said fluid reservoir, the reciprocation of said pneumatic piston and said second hydraulic piston continuing until the fastener is set by the movement and force of said first hydraulic piston and the operator releases said actuating means whereby said first valve means is moved to said closed condition and said installation tool is returned to its idle condition, said installation tool in its idle condition having said first valve means in its closed condition with said pneumatic piston and thus said second hydraulic piston being moved to fixed uppermost positions by the pneumatic pressure in said pneumatic cylinder, a separator plate located in said pneumatic cylinder cavity between said pneumatic piston and said first valve means, said second valve means including a valve opening in said separator plate with said valve actuator being operative with said valve opening for placing said valve opening in an open or closed condition in response to reciprocation of said pneumatic piston, whereby said second valve means blocks the flow of pneumatic pressure from said pneumatic cylinder cavity when in the closed condition and permits the flow of pneumatic pressure from said pneumatic cavity when in the open condition, said second valve means including lost motion means connecting said valve actuator to said pneumatic piston whereby said valve actuator engages said valve opening to close said second valve means before said pneumatic piston reaches the end of its down stroke and remains engaged with said valve opening until said pneumatic piston has reached a preselected position during its upward stroke.

21. The installation tool of claim 20 including access valve means operatively connected to said first and second hydraulic cylinders and being normally biased closed but being actuable to open in response to fluid pressure resulting from movement of said second hydraulic piston in said compressive direction and being actuable by engagement with said second hydraulic piston when in its fixed uppermost position whereby hydraulic fluid in said first hydraulic cylinder will be returned to said fluid reservoir through said second hydraulic cylinder as said first hydraulic piston is moved to its idle condition, said first valve means and said second valve means being operatively connected such that during actuation of said installation tool by the manually actuated means said pneumatic piston and hence second hydraulic piston will be reciprocated between the open and closed conditions of said second valve means while moving a distance less than to their fixed uppermost positions, a high pressure relief valve connected to said second hydraulic cylinder and being selectively operable in response to a preselected magnitude of high fluid pressure in said second hydraulic cylinder to open and to relieve the fluid pressure with flow of hydraulic fluid back to said fluid reservoir, refill valve means operable for permitting flow of hydraulic fluid from said fluid reservoir into said second hydraulic cylinder upon movement of said second hydraulic piston in said non-compressive direction, said pressure relief valve means, said refill valve means, said access valve means, said pneumatic valve actuator and said valve opening being substantially axially in line with said second hydraulic piston along the axis of reciprocation of said second hydraulic piston.

* * * * *